US010774550B2

(12) United States Patent
Anderson et al.

(10) Patent No.: US 10,774,550 B2
(45) Date of Patent: Sep. 15, 2020

(54) WALK-BEHIND FLOOR SCRAPER MACHINE

(71) Applicant: Anderson Innovations, LLC, Two Harbors, MN (US)

(72) Inventors: Martin L. Anderson, Two Harbors, MN (US); Quinn M. Anderson, Ephrata, WA (US)

(73) Assignee: Anderson Innovations, LLC, Two Harbors, MN (US)

( * ) Notice: Subject to any disclaimer, the term of this patent is extended or adjusted under 35 U.S.C. 154(b) by 22 days.

(21) Appl. No.: 16/375,626

(22) Filed: Apr. 4, 2019

(65) Prior Publication Data

US 2019/0226221 A1 Jul. 25, 2019

Related U.S. Application Data

(62) Division of application No. 15/726,984, filed on Oct. 6, 2017, now Pat. No. 10,294,683.

(51) Int. Cl.
*E04G 23/00* (2006.01)
*A47L 13/02* (2006.01)

(52) U.S. Cl.
CPC ..... *E04G 23/006* (2013.01); *A47L 13/02* (2013.01)

(58) Field of Classification Search
CPC ..... E04G 23/006; B62D 51/04; B62D 51/06; B62D 51/065
See application file for complete search history.

(56) References Cited

U.S. PATENT DOCUMENTS

| | | | |
|---|---|---|---|
| 3,279,637 | A | 10/1966 | Olson et al. |
| 4,668,017 | A | 5/1987 | Peterson et al. |
| 4,683,657 | A | 8/1987 | Anderson et al. |
| 5,037,160 | A | 8/1991 | Ukai |
| 5,082,330 | A | 1/1992 | Holder |
| 5,285,863 | A | 2/1994 | Miki |

(Continued)

FOREIGN PATENT DOCUMENTS

| | | | |
|---|---|---|---|
| EP | 1022410 | A1 | 7/2000 |
| JP | 2017095906 | A | 6/2017 |

OTHER PUBLICATIONS

National; "Flooring Tools & Equipment", Catalog 2004, 4 pages.

(Continued)

*Primary Examiner* — Janine M Kreck
(74) *Attorney, Agent, or Firm* — Merchant & Gould P.C.

(57) ABSTRACT

A walk-behind floor scraper machine for removing floor covering from a floor surface is disclosed. In one aspect, the machine includes a base frame, an electric motor secured to the base frame, and a scraper assembly movably secured to the base frame and driven by the electric motor. The machine also includes a rear wheel arrangement including a pair of wheels having a rotational axis. In one aspect, the machine includes a hydraulic circuit with a hydraulic pump driven by the electric motor and a hydraulic motor powered by the hydraulic pump. The hydraulic motor has a drive axle coupled to the wheels, wherein the drive axle is coaxially aligned with the rotational axis. In one aspect, the machine can include a hydraulic tank-frame integral to the chassis of the machine that simultaneously stores hydraulic fluid and structurally supports the hydraulic motor.

14 Claims, 35 Drawing Sheets

(56) References Cited

U.S. PATENT DOCUMENTS

| | | | | |
|---|---|---|---|---|
| 5,426,805 | A * | 6/1995 | Fisher | E01H 1/056 15/79.2 |
| 5,489,150 | A | 2/1996 | Whiteman | |
| 5,641,206 | A | 6/1997 | Craft | |
| 5,702,161 | A | 12/1997 | Finney et al. | |
| 5,713,637 | A * | 2/1998 | Worden | E04G 23/006 15/93.1 |
| 5,772,284 | A | 6/1998 | Lindsey et al. | |
| 5,830,313 | A | 11/1998 | Smith | |
| 5,992,791 | A | 11/1999 | Tsuda et al. | |
| 6,092,876 | A | 7/2000 | Arbucci | |
| 6,135,566 | A * | 10/2000 | Anderson | E04G 23/006 299/36.1 |
| 6,230,410 | B1 | 5/2001 | Taylor et al. | |
| 6,264,282 | B1 | 7/2001 | Gaumont | |
| 6,273,513 | B1 | 8/2001 | Pope | |
| 6,293,364 | B1 * | 9/2001 | Anderson | B60K 15/063 180/312 |
| 6,343,981 | B1 | 2/2002 | Buchanan | |
| 6,540,305 | B2 | 4/2003 | Phillips | |
| 6,609,762 | B2 | 8/2003 | Anderson | |
| 6,813,834 | B2 | 11/2004 | Anderson | |
| 7,082,686 | B2 | 8/2006 | Anderson | |
| 7,228,808 | B1 | 6/2007 | Anderson | |
| 7,562,412 | B1 | 7/2009 | Anderson | |
| 7,563,153 | B2 | 7/2009 | Haddadi | |
| 7,563,156 | B2 | 7/2009 | Anderson | |
| 2001/0022463 | A1 | 9/2001 | Pope | |
| 2002/0109394 | A1 | 8/2002 | Phillips | |
| 2002/0190568 | A1 | 12/2002 | Anderson | |
| 2003/0040265 | A1 | 2/2003 | Palushi | |
| 2010/0201181 | A1 | 8/2010 | Pope | |

OTHER PUBLICATIONS

SASE Company, "SASE "Cyclone" Battery Powered Floor Scrapper", Retrieved on Jul. 8, 2004, Available at: http://www. sasecompany.com/surface_preparation_equipment/floor_scrapers/fl_cyclone.htm, 1 page.

SASE Company, "SASE "Twister" Propane Powered Floor Scrapper", Retrieved on Jul. 8, 2004, Available at: http://www.sasecompany.com/surface_preparation_equipment/floor_scrapers/fl_twister.htm, 1 page.

Innovatech Products & Equipment Company, "Terminator 2000-ei", Retrieved on Jul. 7, 2004, Available at: http://www.store.yahoo.com/innovatechproducts/te20inbapofl.html, 1 page.

SASE Company, "SASE "Floornado" Electric Floor Scrapper", Retrieved on Jul. 8, 2004, Available at: http://www.sasecompany.com/surface_preparation_equipment/floor_scrapers/fl_floornado.htm, 1 page.

Blastpro MFG, "Equiptment List", Aug. 14, 2014, 2 pages.

National Surface Preparation Equipment, "Surface Preparation Solutions" CAT#11-1, pp. 29-43; date unknown but before Jun. 21, 2017.

National Flooring Equipment, "Surface Preparation Equipment", 2017, 73 pages.

International Search Report and Written Opinion for Application No. PCT/US2018/054390 dated Jan. 24, 2019, 15 pages.

* cited by examiner

WALK-BEHIND FLOOR SCRAPER MACHINE

CROSS REFERENCE TO RELATED APPLICATIONS

This application is a divisional of U.S. Ser. No. 15/726,984, filed Oct. 6, 2017, which is incorporated herein by reference. A claim of priority is made to the above disclosed application.

TECHNICAL FIELD

This disclosure relates to a walk-behind floor scraper machine for stripping materials, such as adhesive bonded floor coverings or any type of floor covering (e.g., ceramic, wood, tile, epoxy and urethane coatings, thin mil coatings, etc.), from floor surfaces.

BACKGROUND

Walk-behind floor scraper machines are known. Many prior art walk-behind floor scraper machines include drive systems that are either electric or hydraulic. In typical hydraulically driven machines, a hydraulic motor is coupled to a drive wheel axle via pulleys, sprockets, gears, chains and/or belts which results in significant drivetrain losses. Some typical hydraulic driven machines also include a hydraulic fluid tank that must be removed from the machine in order to service certain components of the machine, such as the hydraulic pump, hydraulic lines and fittings, the tank suction strainer, and the electrical controls and connections to the electric motor.

Improvements in machines for stripping of floor coverings from floor surfaces are desirable.

SUMMARY

In one aspect of the disclosure, a walk-behind floor scraper machine for removing floor covering from a floor surface is disclosed. Due to the design and construction of the disclosed walk-behind floor scraper machine, a part reduction of about 50 percent and an operational efficiency gain of about 30 percent (i.e. performance increase) can be achieved over typical prior art hydraulically powered walk-behind floor scraper machines. The efficiency gain is largely due to the wheels of the machine being directly driven by a hydraulic motor which allows for the removal of high loss components in the driveline that propel the machine, such as the removal of multiple sprockets and a roller chain. The 30 percent performance gain significantly reduces amp draw on the electric motor of the machine and allows the machine to have 30 percent more speed or power, or to be made heavier without affecting performance. In one example, the disclosed machine can be made about 18 percent heavier than a typical prior art machine making it more effective at scraping. In one example, the disclosed machine can operate with a take up rate of about 70 feet per minute in comparison to a typical prior art machine of similar size which has a take up rate of about 30 to 40 feet per minute. The reduction in amp draw due to the disclosed configuration also allows for a longer extension cord to be used with the machine. The design and construction of the disclosed walk-behind floor scraper machine also results in a machine that is significantly stronger from a structural standpoint, in comparison to typical prior art machines.

In some examples, the walk-behind floor scraper machine includes a base frame, an electric motor secured to the base frame, and a scraper assembly movably secured to the base frame and driven by the electric motor.

In some examples, the scraper assembly and electric motor are configured to move the scraper assembly in an orbital motion. By use of the term orbital motion, it is meant to include both elliptical and circular motions. In some examples, the scraper assembly and electric motor are configured to move the scraper assembly in a reciprocating motion.

In some examples, the walk-behind floor scraper is configured with a rear wheel arrangement including a pair of wheels having a rotational axis. In some examples, the wheels have a diameter of about 9 inches and are set apart (outside of one wheel to outside of other wheel) by about 12 inches. In some examples, the wheels are formed from a metal material with a rubber coating at the outside diameter. Such a configuration can result in a desirably heavy wheel.

In some examples, the walk-behind floor scraper is configured with a hydraulic circuit that includes a hydraulic pump driven by the electric motor and a hydraulic motor powered by the hydraulic pump, wherein the hydraulic motor powers the rear wheel arrangement which is mounted directly to the motor shaft.

In a particularly advantageous configuration, the hydraulic motor has a drive axle or pair of drive axles that are coaxially aligned with the rotational axis of the pair of wheels. In one example, the drive axles are directly coupled to the pair of wheels. Such a construction eliminates the need for multiple pulleys, sprockets, gears, chains and/or belts typically associated with prior art hydraulic floor scraper machine drivetrains which significantly increases the efficiency and performance of the machine, as noted previously. The hydraulic motor is configured such that it can successfully power smaller diameter wheels (e.g. 9 inch wheels) and such that they have a limited set-apart width (e.g. 12 inches) with the hydraulic motor still being located between the wheels. Some hydraulic motors require much larger wheel diameters than 9 inches in order to satisfactorily operate, which would make them incompatible with walk-behind floor scraper machines of the type disclosed herein as the machine would be unstable and not be able to achieve the optimal angle between the blade and the floor surface (e.g. 22 degrees) that can be accomplished with the disclosed design. Also, the use of dual hydraulic motors (i.e. one motor per wheel) would result in an undesirable set-apart width that would also be incompatible with walk-behind floor scraper machines of the type disclosed herein. Dual motors also increase the inefficiency of the hydraulic system, add additional failure points, and create an issue with the wheels not driving at the exact same speed causing the machine to veer to one direction or another.

In some examples, the hydraulic circuit is configured such that the rear wheel arrangement can be driven such that the pair of wheels propel the machine in a forward direction with an operator input member in a first position and in a reverse direction with the operator input member in a second position. The operator input member, in some examples, can be connected to a hydraulic valve (e.g. spool and sleeve type valve, cartridge valve, etc.) in the hydraulic circuit. The operator input member, in some examples, can be connected to the hydraulic pump (e.g. a hydrostatic pump) to control a swashplate position.

In some examples, the walk-behind floor scraper machine can include a hydraulic fluid storage tank mounted to the base frame. In some examples, the hydraulic fluid storage tank can be configured as a tank-frame assembly that additionally supports the hydraulic motor. In some examples, the base frame is welded to the tank-frame assembly such that the chassis of the machine is formed by the joined tank-frame assembly and the base frame. Such a configuration allows for the hydraulic pump, which is mounted to the base frame, to be serviced without requiring removal of the hydraulic tank, unlike typical prior art designs. Where a hydrostatic type pump is utilized, the tank interior volume can be provided at a reduced size in comparison to configurations where a gear-type pump is utilized. For example, a tank size of about a quart can be utilized instead of a tank size of about 2 gallons.

In some configurations, the hydraulic fluid storage tank or tank-frame assembly is located vertically above the hydraulic motor drive axle. Such a configuration adds weight to the wheels such that greater traction results.

In some examples, the base frame includes a first projection and a second projection that extend into corresponding openings of the tank-frame assembly, wherein the base frame is welded to the tank-frame assembly at the location of the first and second projections.

In some examples, the walk-behind floor scraper machine includes a foldable handle assembly mounted to the tank-frame assembly.

In some examples, the tank-frame assembly includes a first part having a first end wall extending between a first pair of sidewalls and a second part having a second end wall extending between a second pair of sidewalls, and wherein the interior volume is defined by the first and second end walls and the first and second pair of sidewalls. In some examples, the hydraulic motor is mounted to the first pair of sidewalls of the tank-frame assembly first part. In some configurations, each of the first pair of sidewalls includes a recessed portion for receiving and supporting the hydraulic motor.

In one aspect of the disclosure a subassembly for a walk-behind floor scraper machine can be formed. In one example subassembly, a base frame, a scraper assembly, a tank-frame assembly, and a foldable handle assembly are provided. In one aspect, a welded subassembly can include the base frame, the tank-frame assembly, the handle assembly support arms, and the mounting bracket for holding a front weight assembly.

In some examples, the subassembly or walk-behind floor scraper machine base frame extends between a first end and a second end and defines a first opening and bolt pattern for accepting one of a plurality of different electric motor sizes. In some examples, the base frame is provided with a 4-bolt opening pattern to accept 56C frame dimensioned motors ranging from ½ horsepower to three horsepower. In some examples, the base frame defines a second opening and bolt pattern for accepting one of a plurality of different hydraulic pump sizes and types (e.g. 2 cc-9 cc hydrostatic and gear type pumps). Thus, the disclosed subassembly or walk-behind floor scraper machine is modular in design and can be provided with many different pump and motor configurations without requiring any changes to the base frame.

In some examples, the subassembly or walk-behind floor scraper machine scraper assembly is movably secured to the base frame by a plurality of bushings or vibration isolators and bolts. In some configurations, four bushings or vibration isolators are used. In other configurations, five to eight vibration isolators or bushings are used where the machine is more heavily weighted. The subassembly can be configured such that the scraper assembly can be configured to move in one or both of an orbital pattern and a reciprocating pattern. Where configured for a reciprocating pattern, blocks and linear bearings can be utilized instead of bushings.

In some examples, the subassembly or walk-behind floor scraper machine tank-frame assembly includes a mounting location for a hydraulic motor and defines an interior volume for storing hydraulic fluid of the hydraulic circuit.

In some examples, the subassembly or walk-behind floor scraper machine foldable handle assembly is mounted to the tank-frame assembly. In some examples, the foldable handle assembly is movable between a stored position in which a portion of the handle assembly is generally parallel to the base frame and an operating position in which the portion extends at an oblique angle away from the base frame.

In some examples, the subassembly or walk-behind floor scraper machine includes a weighted shroud removably mounted to the base frame, wherein the weighted shroud includes at least one weight permanently (e.g. by welding) or removably mounted to a shroud member defined by a top wall extending between a pair of sidewalls.

In some examples, the subassembly or walk-behind floor scraper machine includes a front weight assembly mounted to the base frame with fasteners extending in a direction parallel to a top surface or length of the base frame. In some examples, the fasteners are bolts and extend from a front face to a rear face of the front weight assembly. This configuration is a significant improvement (e.g. about four times the strength) over prior art designs which utilize bolts or rods that extend the height of the front weight. In some examples, the front weight assembly is provided with a weight of between 20 pounds and 100 pounds (e.g. 32 pounds). In some examples, the base frame is configured to receive differently size/weight front weight assemblies such that the machine can be modified to best suit a particular application. In some examples, the front weight assembly includes machined weights. In some examples, the front weight assembly includes molded weights.

In some examples, the weighted shroud and the front weight assembly can be provided with weights that allow the subassembly walk-behind floor scraper machine to be selectively provided with a total weight between 100 pounds and 700 pounds. The machine is configured such that removable weights can be added to the machine, for example to the weighted shroud, to achieve these higher weights. This removability enables a single operator to more easily and quickly load the machine onto a vehicle without the use of ramps, as the machine with the weights removed can be carried by the operator. This aspect also allows for the machine and weights to be separately transported in elevators, which have maximum weight limits.

A variety of additional aspects will be set forth in the description that follows. The aspects can relate to individual features and to combinations of features. It is to be understood that both the forgoing general description and the following detailed description are exemplary and explanatory only and are not restrictive of the broad inventive concepts upon which the examples disclosed herein are based.

BRIEF DESCRIPTION OF THE DRAWINGS

The accompanying drawings, which are incorporated in and constitute a part of the description, illustrate several aspects of the present disclosure. A brief description of the drawings is as follows.

DETAILED DESCRIPTION

Figure 1:
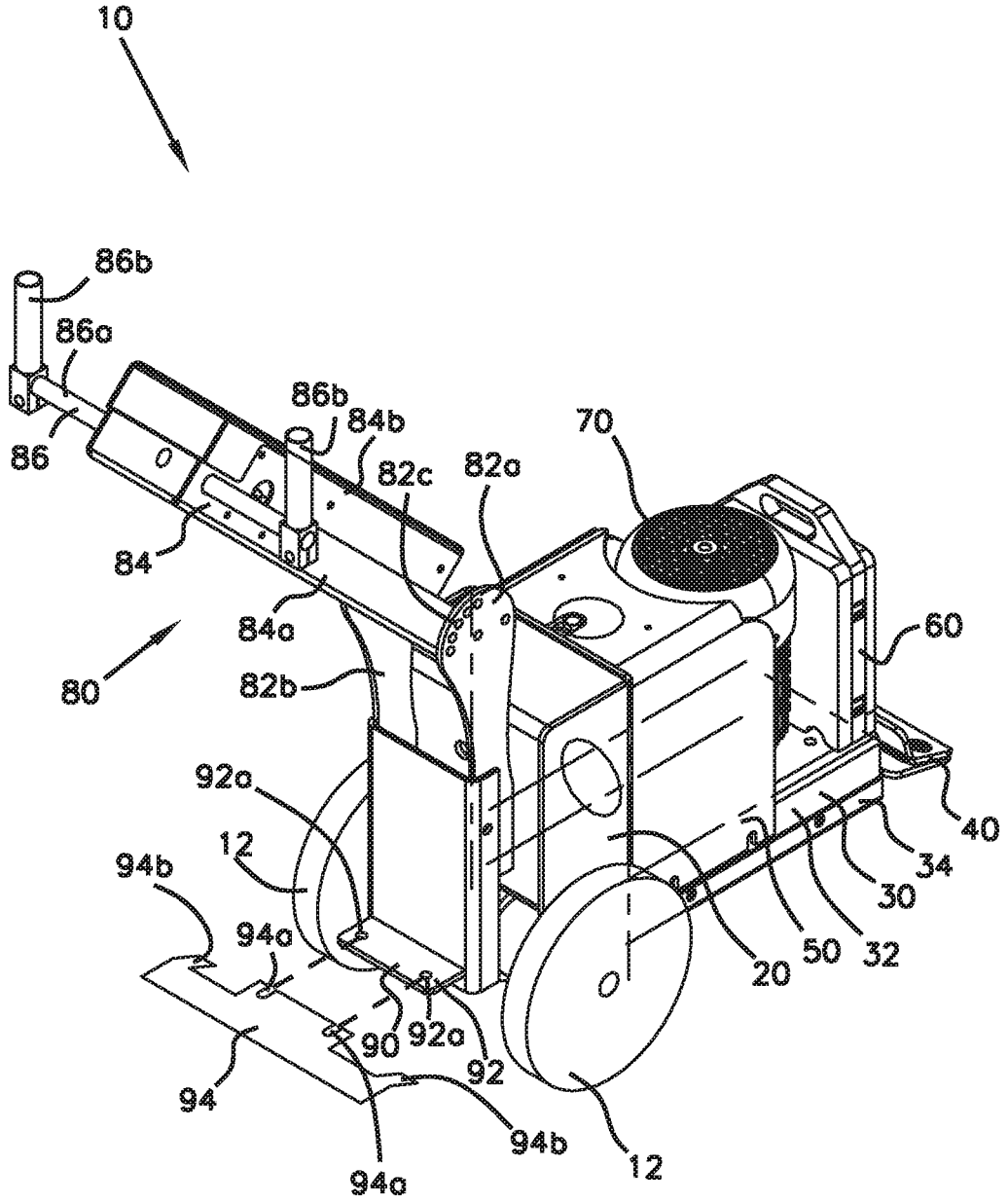
FIG. 1 is a rear top perspective view of an embodiment of a walk-behind floor scraper machine, constructed in accordance with principles of this disclosure.

Various examples will be described in detail with reference to the drawings, wherein like reference numerals represent like parts and assemblies throughout the several views. Reference to various examples does not limit the scope of the claims attached hereto. Additionally, any examples set forth in this specification are not intended to be limiting and merely set forth some of the many possible examples for the appended claims. Referring to the drawings wherein like reference numbers correspond to like or similar components throughout the several figures.

Figure 2:
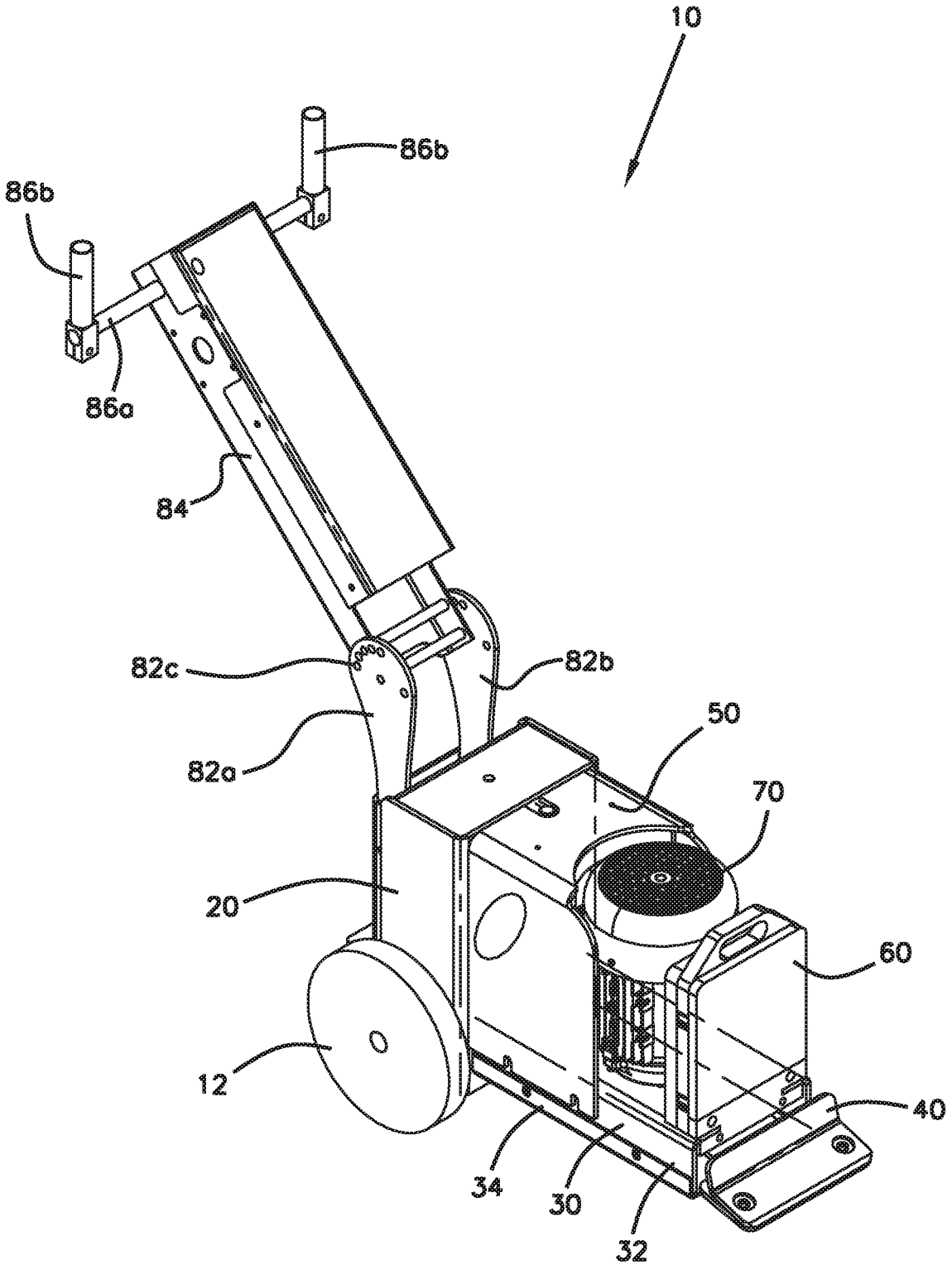
FIG. 2 is a front top perspective view of the walk-behind floor scraper machine shown in FIG. 1.
Figure 2A:
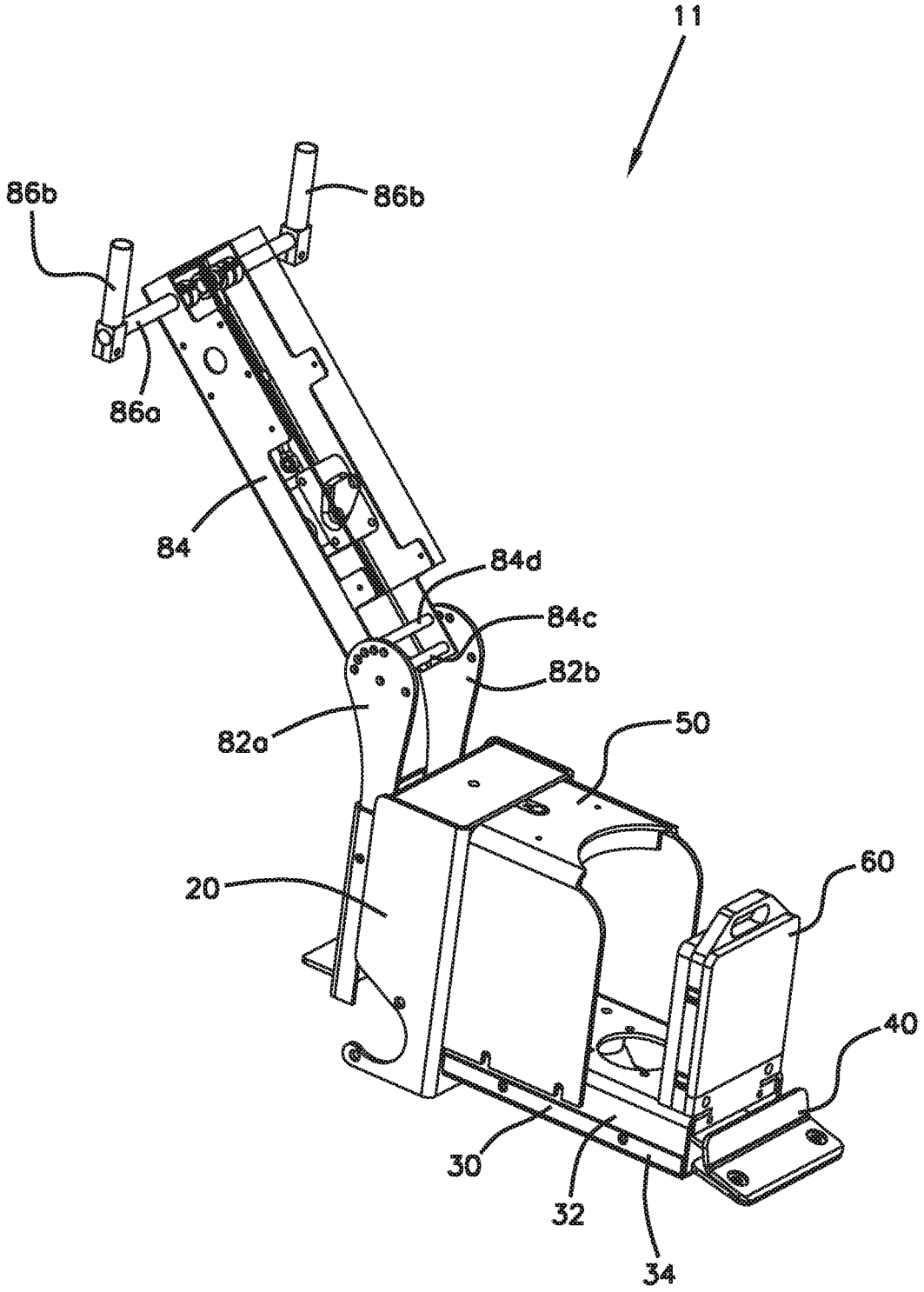
FIG. 2A is a front top perspective view of a frame subassembly of the walk-behind floor scraper machine shown in FIG. 1.
Figure 2B:
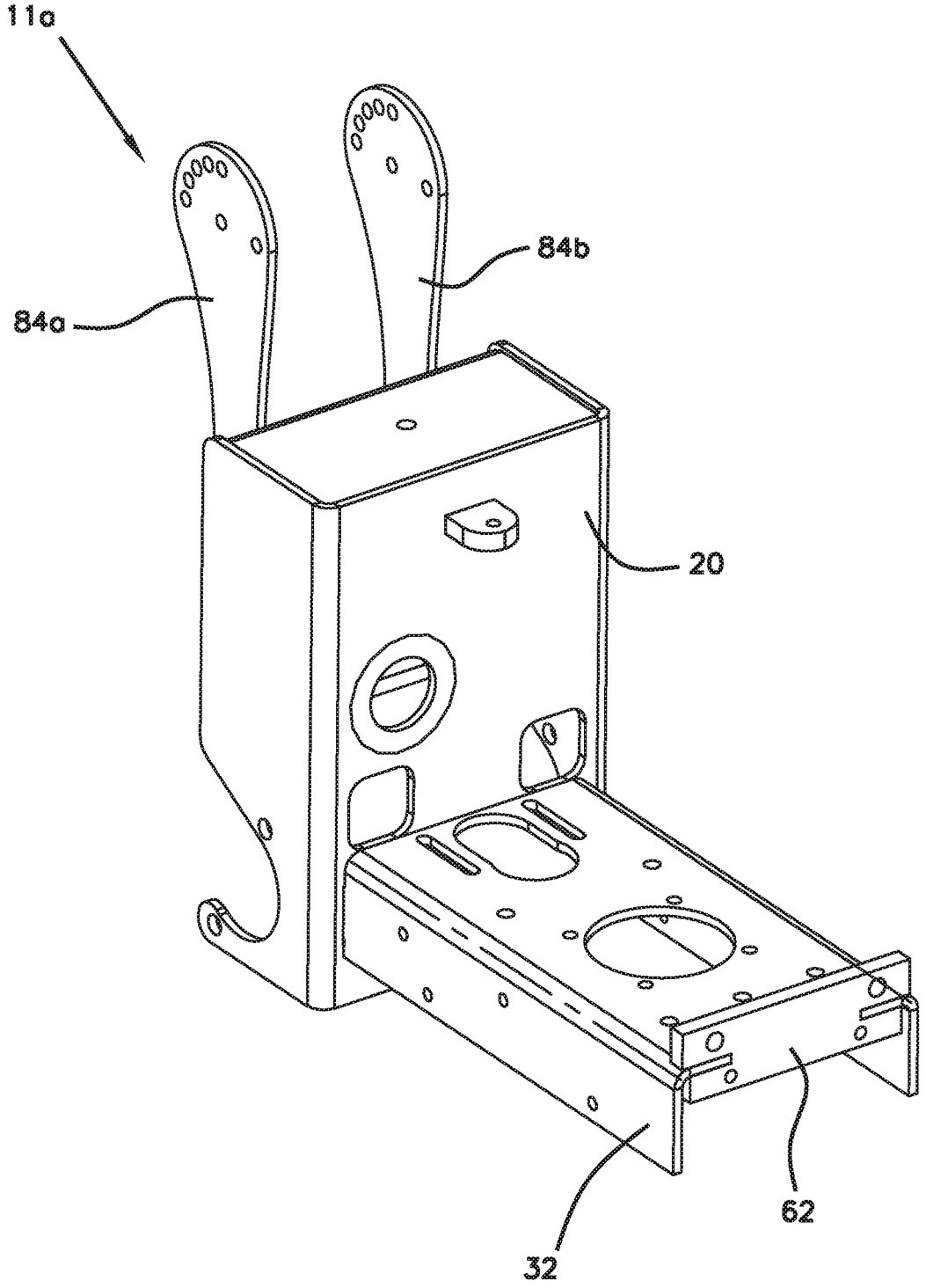
FIG. 2B is a front top perspective view of a frame subassembly of the walk-behind floor scraper machine shown in FIG. 1.
Figure 3:
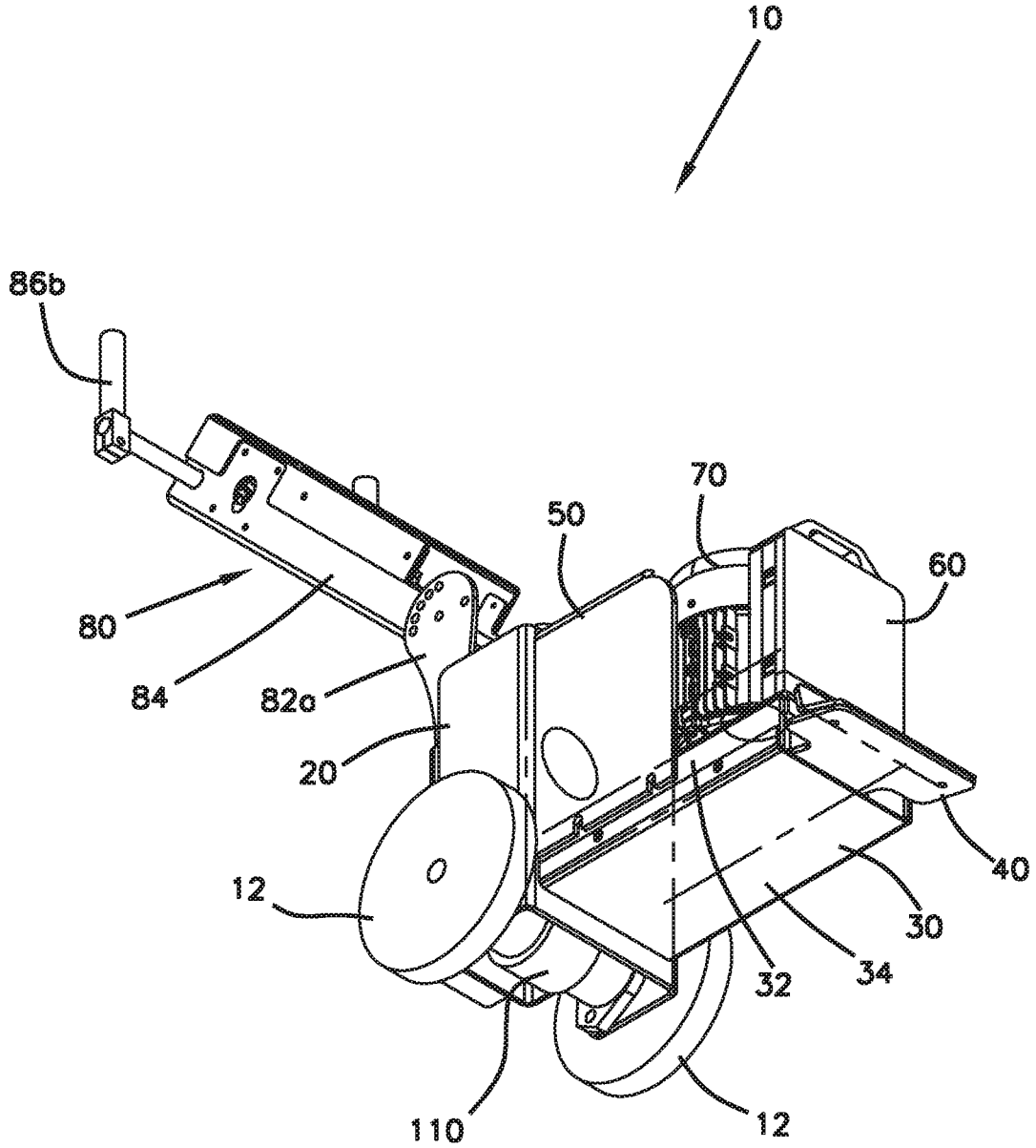
FIG. 3 is a front bottom perspective view of the walk-behind floor scraper machine shown in FIG. 1.
Figure 4:
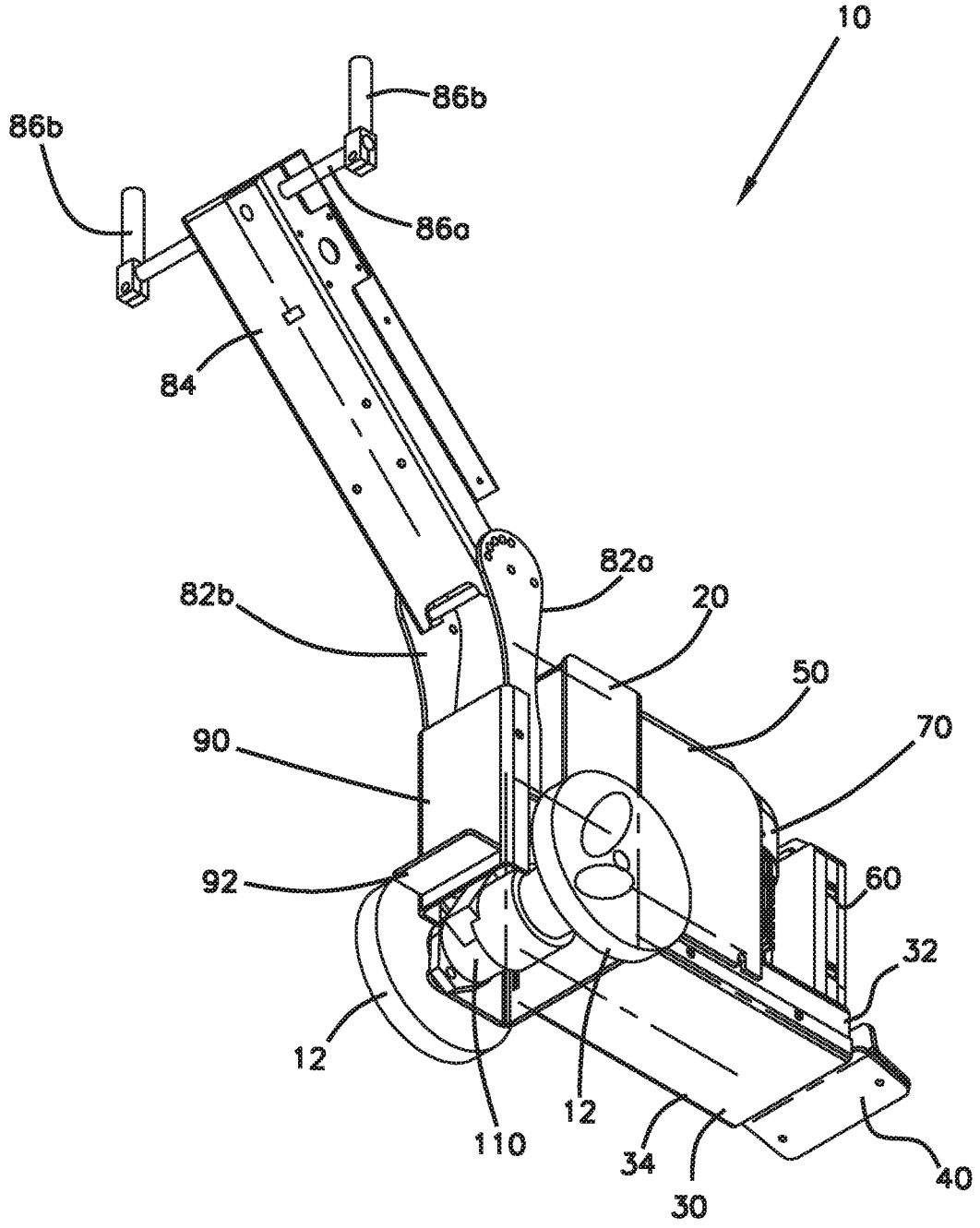
FIG. 4 is a rear bottom perspective view of the walk-behind floor scraper machine shown in FIG. 1.
Figure 5:
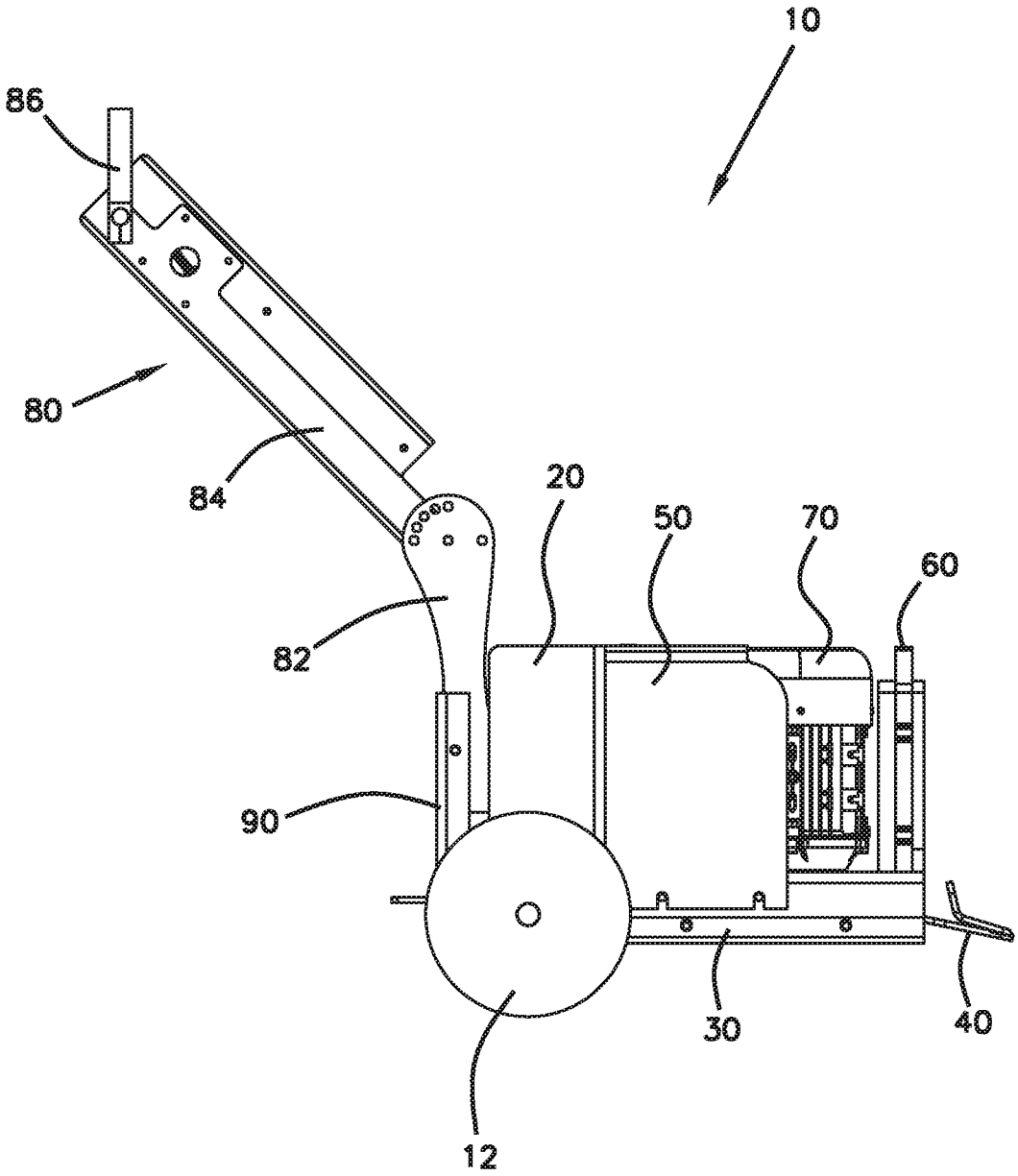
FIG. 5 is a side view of the walk-behind floor scraper machine shown in FIG. 1.
Figure 6:
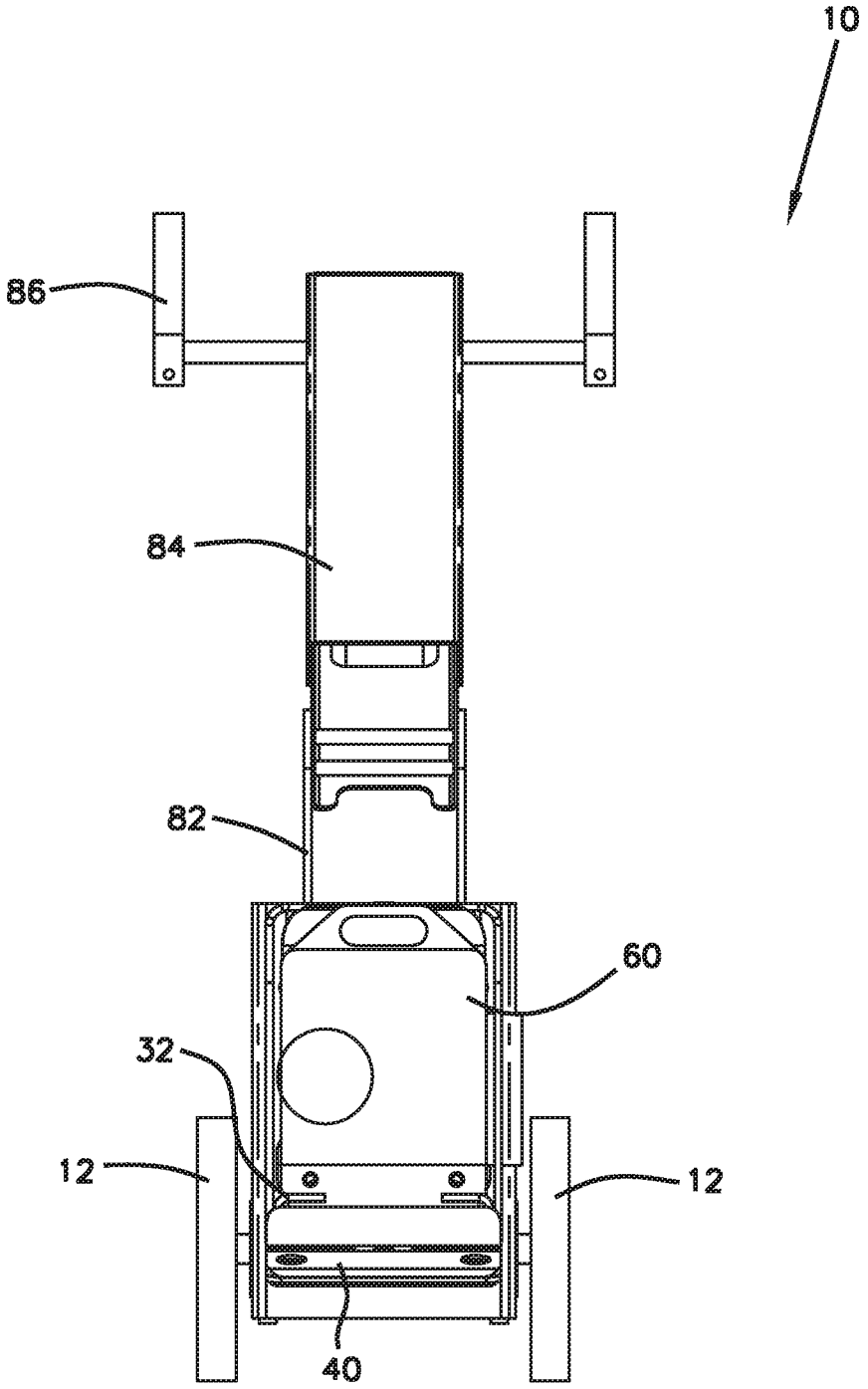
FIG. 6 is a front view of the walk-behind floor scraper machine shown in FIG. 1.
Figure 7:
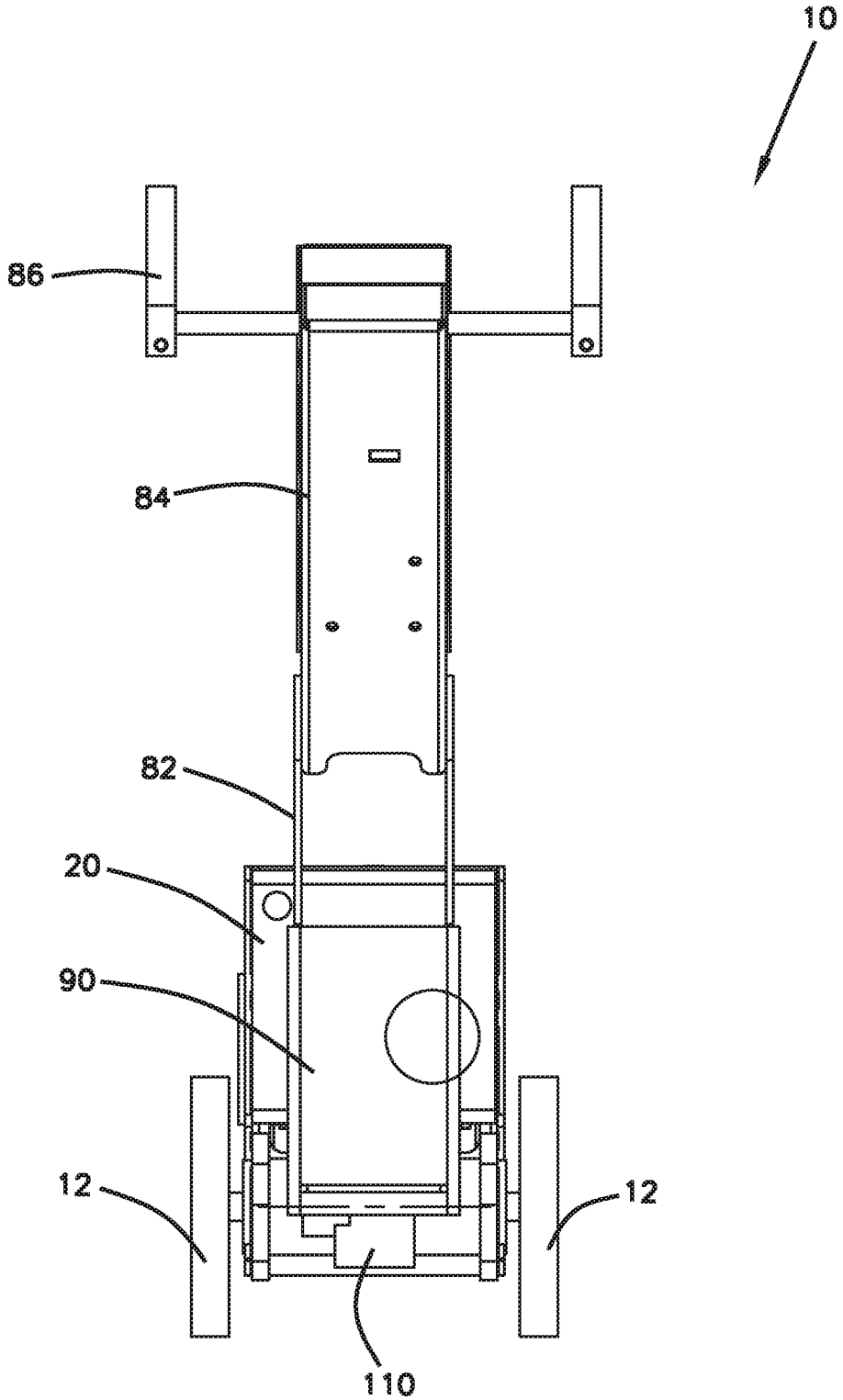
FIG. 7 is a rear view of the walk-behind floor scraper machine shown in FIG. 1.
Figure 8:
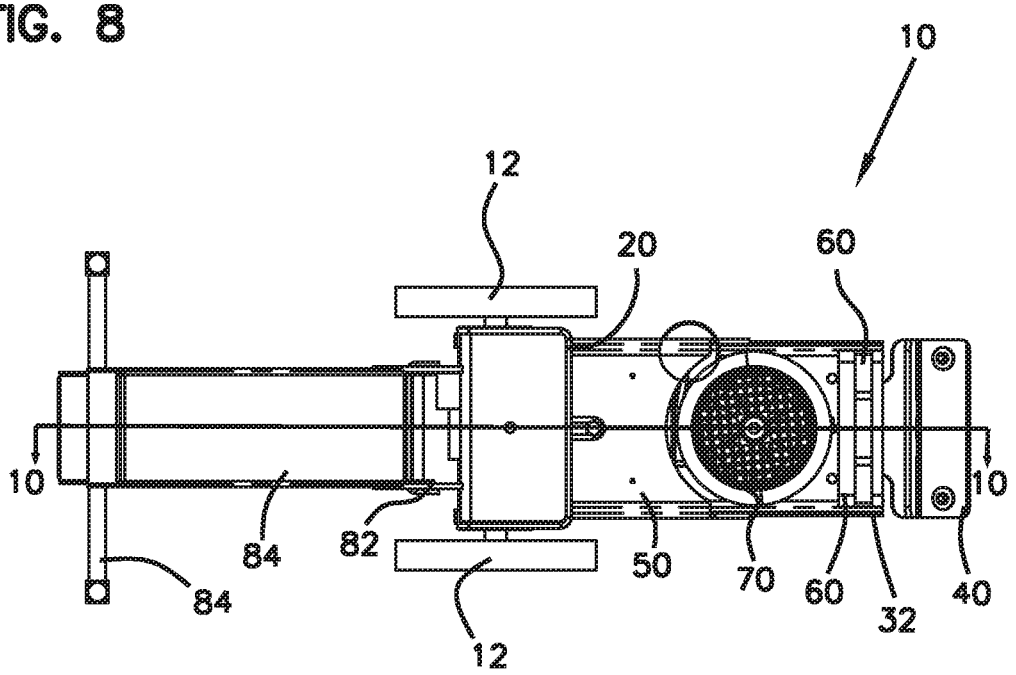
FIG. 8 is a top view of the walk-behind floor scraper machine shown in FIG. 1.
Figure 9:
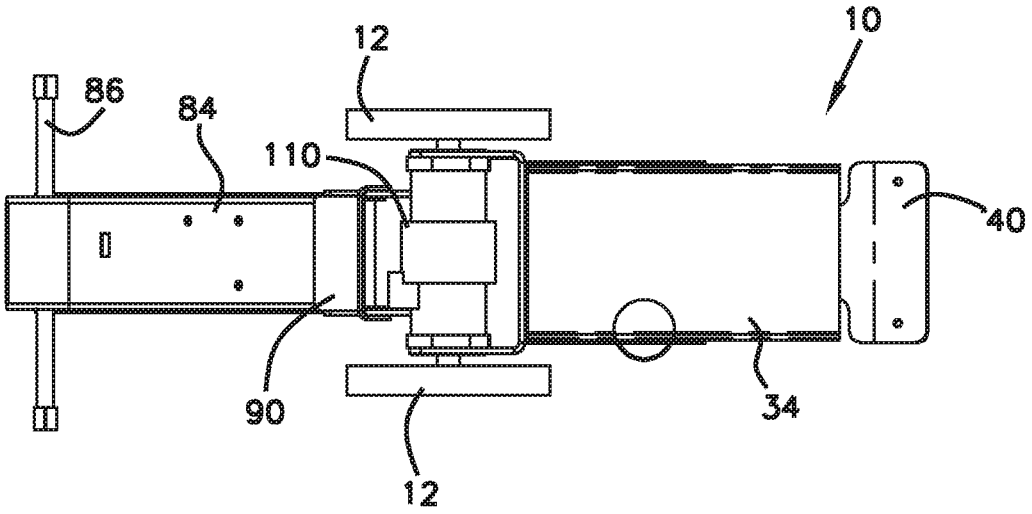
FIG. 9 is a bottom view of the walk-behind floor scraper machine shown in FIG. 1.
Figure 10:
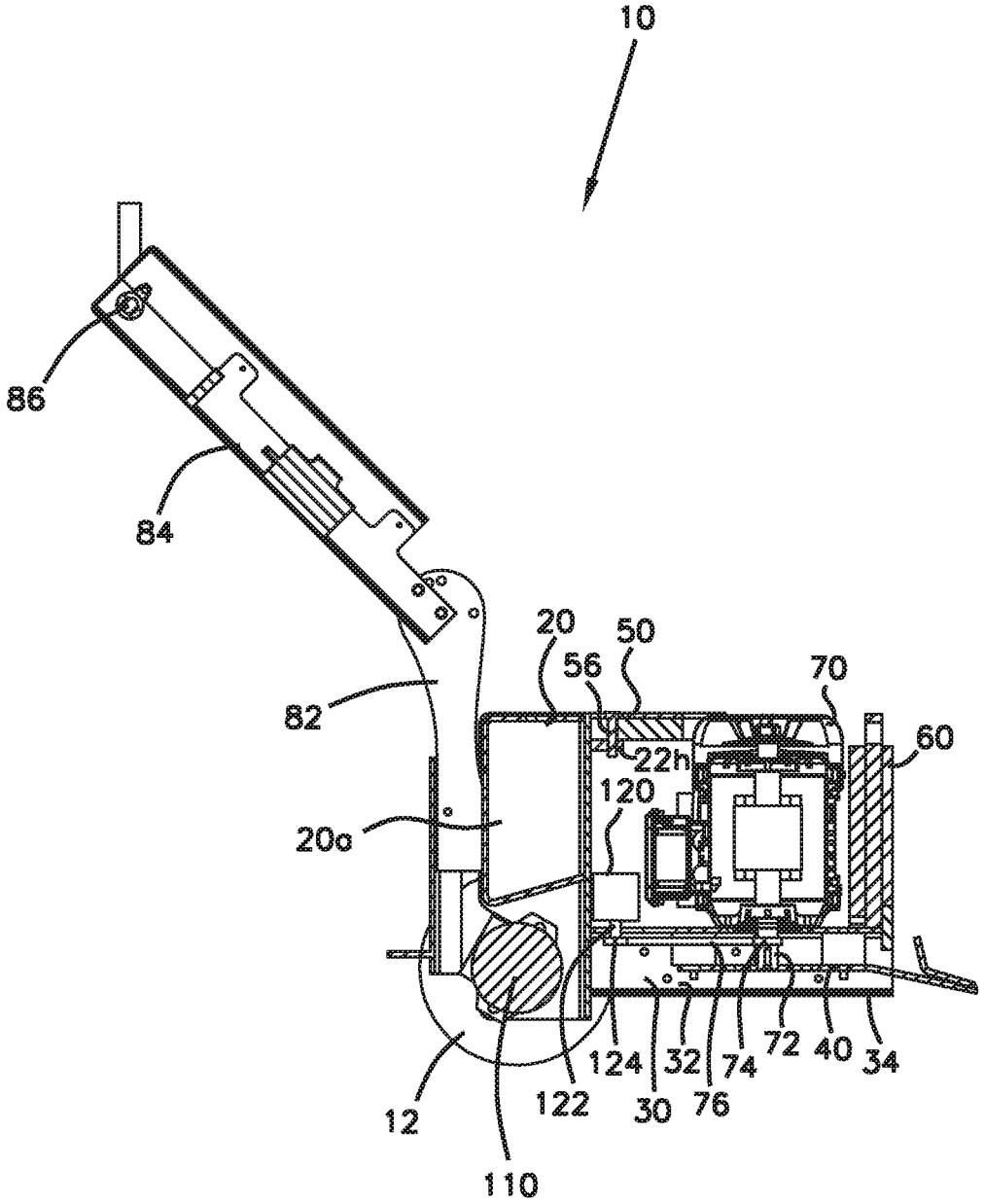
FIG. 10 is a cross-sectional view of the walk-behind floor scraper machine shown in FIG. 1, taken along the line 10-10 at FIG. 8.

Referring to FIGS. 1-11, an example walk-behind floor scraper machine 10 is shown. In one aspect, the machine 10 includes a subassembly 11 which does not include the drivetrain and motorized components of the machine 10, as shown at FIG. 2A. The subassembly 11 is built upon a structural frame subassembly 11*a* that includes a tank-frame assembly 20 connected to a base frame 32, a pair of support arms 82*a*, 82*b* connected to the tank-frame assembly 20, and a front weight mounting bracket 62 connected to the base frame 32. In one example, the tank-frame assembly 20, base frame 32, support arms 82*a*, 82*b*, and mounting bracket 62 are welded together to form a single rigid chassis. The base frame 32 can be connected to a bottom cover 34 to form a base frame assembly 30. The bottom cover 34 is for protecting the underside of the machine 10. The base frame assembly 30, support arms 82*a*, 82*b*, and mounting bracket 62 are discussed in further detail later in this description.

The tank-frame assembly 20 stores hydraulic fluid associated with a hydraulic system 100, as described in more detail later, and structurally supports a hydraulic motor 110. The hydraulic motor 110 is connected to and drives a pair of wheels 12. In one example, the wheels 12 are solid metal wheels provided with a rubber or plastic covering at the outer perimeter to provide traction against a floor surface. As it is desirable for a floor scraper machine to be relatively heavy, high mass wheels can be advantageous.

The walk-behind floor scraper machine 10 can be provided with further features that add weight to the machine 10. For example, the machine 10 can be provided with a weighted shroud 50 and a front weight assembly 60, both of which include integral or connected weights. In one example, the weighted shroud 50 weighs about 17 pounds while the front weight assembly 60 weighs about 32 pounds. The weighted shroud 50 and front weight assembly 60 can be provided with different weights without departing from the concepts herein. The weighted shroud 50 simultaneously functions to add weight to the machine 10 and to provide a protective covering for components of the hydraulic system 100. In one example, the weighted shroud 50 is bolted to the base frame 32 and to the tank-frame assembly 20. A front weight 64 of the front weight assembly 60 is bolted to the front of the base frame 32 via the mounting bracket 62. The weighted shroud 50 and a front weight assembly 60 are discussed in further detail later in this description.

The walk-behind floor scraper machine 10 is also shown as including a scraper assembly 40 that is driven by an electric motor 70 in either a reciprocating or an orbital motion. The electric motor 70 is mounted (e.g. bolted) to the base frame 32 and has a shaft 72 that extends to the bottom side of the base frame 32, where the shaft 72 is connected to the scraper assembly via an eccentric coupler or fitting 78 and a flange bearing 49. In operation, when the electric motor 70 is activated and the shaft rotates 70, a reciprocating or orbital motion is imparted onto the scraper assembly 40, via the interacting eccentric coupler 74 and flange bearing 49, such that the scraper assembly 40 can be powered to efficiently remove a floor covering material. The scraper assembly 40 is discussed in further detail later in this description.

The walk-behind floor scraper machine 10 is also shown as including a handle assembly 80 for maneuvering and controlling the floor scraper machine 10. As shown, the handle assembly 80 include a first support arm 82*a* and a second support arm 82*b* (collectively support arms or structure 82) that are connected to the tank-frame assembly 20, for example by welding. The support arms 82*a*, 82*b* are arranged in a parallel configuration and each include a plurality of radially arranged openings 82*c*. The handle assembly 80 also includes a handle beam structure 84 with a main beam 84*a* and a cover 84*b*. The main beam 84*a* and cover 84*b* are formed as open channels and can be bent to shape from flat metal (e.g. steel) sheet stock. As shown, the main beam 84*a* is rotatably mounted to and supported by the support arms 82*a*, 82*b* via a pin or axle 84*c*. The handle beam structure 84 also includes an indexing pin 84*d* which can be received into the openings 82*c*, such that the rotational position of the handle beam structure 84 can be indexed and secured at preconfigured positions. In operation, the handle assembly 80 can be rotatably positioned to best suit the height of the operator. In one aspect, the top of the support arms 82*a*, 82*b* is equal to or less than 22 inches from the floor surface upon which the machine 10 rests to allow the machine 10 to extend under a desk when the handle assembly 80 is rotated in a below-horizontal position.

A handle bar assembly 86 including a horizontal bar 86*a* and a pair of handles 86*b* are rotatably secured to the handle beam structure 84. An operator can grip the handles 86*b* and rotate the horizontal bar in either direction to control the direction and speed of the machine 10 via a linkage system 88. As shown, the linkage system includes a rotating member 88*a* fixed to the bar 86*a*, wherein the rotating member 88*a* includes an offset pin that is connected to a linkage member 88*b*. The linkage member 88*b* is connected to another linkage member 88*g* via a tie rod 88*c*. In the embodiment shown, the tie rod 88*c* includes a threaded portion on which two threaded nuts 88*d*, 88*f* are mounted. A fork member 88*e* is attached to the main beam 84*a* and is disposed between the two threaded nuts 88*d*, 88*f* With this structure, the position of the threaded nuts 88*d*, 88*f* can be adjusted to provide end stops against the fork member 88*e* to limit the rotational movement of the bar 86*a*. The linkage member 88*g* is connected to the valve 130 of the hydraulic system 100.

In operation, when the handles 86*b* are pushed forward and rotated clockwise (e.g. from view in FIG. 10), the bar 86*a* is likewise rotated and the tie rod 88*c* is moved in a direction away from the bar and towards the support arms 82 to actuate the hydraulic valve 130 in a first position that causes the hydraulic motor 110 to actuate the machine 10 in a forward direction. Similarly, when the handles 86*b* are pulled backward and rotated counter-clockwise (e.g. from view in FIG. 10), the bar 86*a* is likewise rotated and the tie rod 88*c* is moved in a direction towards the bar 86*a* and away from the support arms 82 to actuate the hydraulic valve 130 in a second position that causes the hydraulic motor 110 to actuate the machine 10 in a reverse direction. The operation of the hydraulic valve 130 and motor 110 of the hydraulic system 100 is explained in further detail later in this section.

The walk-behind floor scraper machine 10 and hydraulic system 100 are further shown as being provided with a hydraulic pump 120 and the aforementioned control valve 130. The hydraulic pump 120 is driven by the electric motor 70, and provides fluid power to the hydraulic motor 110. As described previously, the control valve 130 is controlled via the handle bar assembly 86 and operates to limit fluid flow to the hydraulic motor 110 and to control the rotational direction of the hydraulic motor 110. The hydraulic system 100 is discussed in further detail later in this description.

The walk-behind floor scraper machine 10 is also shown as including a kick plate 90 having a ledge or step 92. The step 92 provides a surface for an operator to use a foot to gain leverage for lifting the front end of the machine in an upward direction. In the example shown, the kick plate 90 is structured as an open channel and is mounted to the support arms 82*b* by mechanical fasteners and/or welding. The kick plate 90 also functions to cover and protect hydraulic lines extending from the handle assembly 80 and from the hydraulic motor 110. Referring to FIG. 1, an optional wheel cleaner attachment 94 is shown. The wheel cleaner attachment 94 can be attached to the step 92 via fasteners extending through openings 92*a* in the step and slots 94*a* of the attachment 94. The attachment 94 can also be provided with bent tabs 94*b* which are located proximate the wheels 12 and operate to scrape debris off of the wheels 12. The slots 94*a* enable the attachment 94 to be located such that the bent tabs 94*b* are set to a desired distance from the wheels 12. In the example shown, the wheel cleaner attachment 94 is shown as being about the same width as the outside-to-outside set apart distance between the wheels and can also be used as a step.

Referring to FIGS. 16-17 and 21-23, the tank-frame assembly 20 is shown in further detail. In the example presented, the tank-frame assembly 20 is formed from a first part 22 and a second part 24. The first part 22 is defined by an end wall 22*a* from which a pair of sidewalls 22*b*, 22*c* extend to form an open channel-like structure. Similarly, the second part 24 is defined by an end wall 24*a* from which a pair of sidewalls 24*b*, 24*c* extend to form an open channel-like structure. Sidewall 24*c*, which forms the bottom of the interior volume 20*a* extends at an oblique angle to the end wall 24*a* to give the tank interior volume 20*a* a sloped bottom. Each of the first part 22 and second part 24 can be formed from a flat sheet of metal (e.g. steel) and bent to the form show in the drawing. A lug 22*h* is also provided on the first part 22 to allow for the weighted shroud 50 to be secured to the tank-frame assembly 20, as discussed later in this section.

As shown, the first and second parts 22, 24 are joined together such that the end walls 22*a*, 24*a* face each other and such that the sidewalls 22*b*, 22*c*, 24*b*, 24*c* form an interior volume 20*a* for holding hydraulic fluid. The interior volume 20*a* can be sized to suit a particular configuration depending upon the type of hydraulic pump 120 and motor 110. In order to allow hydraulic supply and return lines and venting ports to enter the interior volume 20*a*, various openings 22*g* can be provided in the end walls 22*a*, 24*a* and/or sidewalls 22*b*, 22*c*, 24*b*, 24*c*. The openings 22*g* can be provided with bushings, grommets, fittings, and the like to ensure that a leak proof seal exists between the attached components or tubing and the end walls 22*a*, 24*a* and/or sidewalls 22*b*, 22*c*, 24*b*, 24*c*.

Figure 39:
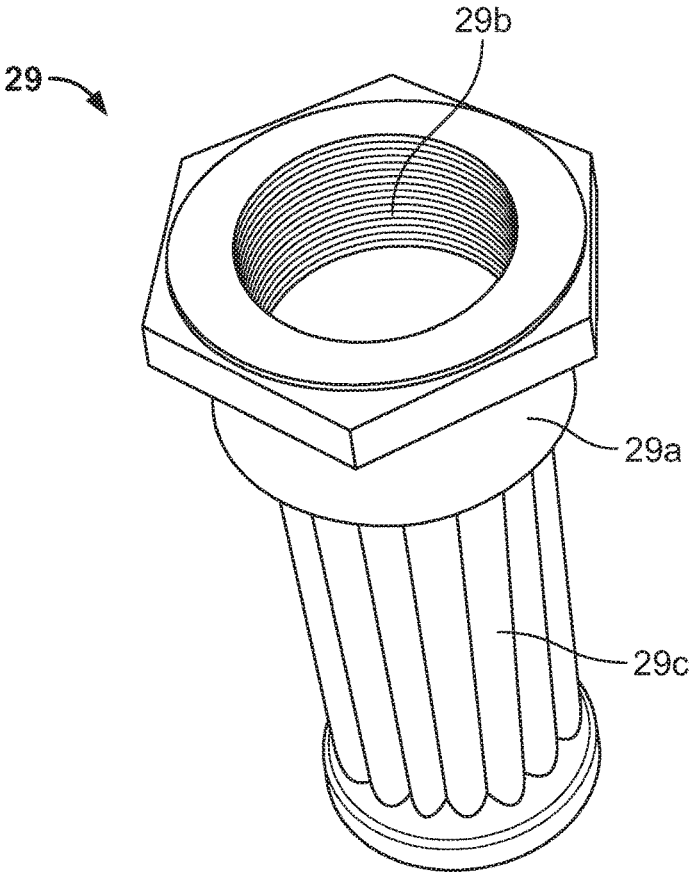
FIG. 39 is a perspective view of an inlet strainer of the floor scraper machine shown in FIG. 1.

In the example shown, one of the openings 22*g* is configured with a threaded fitting 23 for accepting an inlet strainer 29. As shown at FIG. 39, the inlet strainer 29 has a male threaded portion 29*a* which threads into the threaded fitting 23. The inlet strainer 29 also includes a female threaded portion 29*b* for receiving a fitting associated with the inlet line to the hydraulic pump 120. The inlet strainer 29 also includes a strainer portion 29*c* for straining the hydraulic fluid leaving the interior volume 20*a* before it is delivered to the hydraulic pump 120.

In one aspect, the sidewalls 22*b*, 22*c* of the first part 22 of the tank-frame assembly 20 extend beyond the sidewall 24*c* of the second part 24. This portion of the sidewalls 22*b*, 22*c* is provided with a recessed area 22*d* sized and shaped to receive and support the hydraulic motor 110. Mounting openings 22*e* are provided such that fasteners (e.g. bolts, screws, etc.) can be used to removably secure the hydraulic motor 110 to the sidewalls 22*b*, 22*c*. One advantage of integrating the tank into the structural framing of the machine 10 in the disclosed configuration is that the weight of the hydraulic fluid is disposed directly above the hydraulic motor 110, and thus the drive axles of the hydraulic motor and the attached wheels 12. This additional weight allows for the wheels 12 to have increased traction. Another advantage of the disclosed configuration is that the hydraulic motor 110 and the components supported by the base frame 32 (e.g. the pump 120) can be easily accessed without having to first remove a fluid storage tank. Typical prior art hydraulic machines require the full removal of a fluid storage tank in order to service the components supported by the chassis, such as the hydraulic pump and hydraulic motor. Yet another advantage of the disclosed design is that the hydraulic motor 110 imparts structural integrity to the tank-frame assembly 20, and thus the overall assembly, once the hydraulic motor 110 is bolted to the sidewalls 24*b*, 24*c*.

The tank-frame assembly 20 is also provided with a pair of openings or slots 22*f* in the end wall 22*a* of the first part 22. The slots 22*f* are configured to receive corresponding projections 32*d* of the base frame 32 such that the base frame 32 can be adequately aligned to and structurally supported by the first part 22 of the tank-frame assembly 20. In the example shown, the base frame 32 is welded to the first part 22 of the tank-frame assembly 20. Together, the tank-frame assembly 20 and the base frame 32 can be characterized as forming the primary chassis of the machine 10.

Referring to FIGS. 16-20 and 36-37, the components of the base frame assembly 30 are shown in further detail. As shown, the base frame assembly 30 is formed from a base frame 32 and a bottom cover 34. The base frame 32 is shown in isolation at FIGS. 18-20 while the bottom cover is shown at isolation at FIGS. 36 and 37. In one aspect, the base frame 32 is formed as an open channel with a pair of sidewalls 32*b*, 32*c* extending from an end wall 32*a*. As with the components of the tank-frame assembly 20, the base frame 32 can be formed from a flat sheet of metal (e.g. steel) and bent to form. The previously described projections 32*d* extend from the pair of sidewalls 32*b*, 32*c*. The end wall 32*a* of the base frame 32 supports the hydraulic pump 120, the electric motor 70, and the scraper assembly 40. The base frame 32 is provided with a central opening 32*e*, through which the motor shaft 72 can extend, and four-hole bolt pattern 32*f*, for receiving bolts 76 for securing the electric motor 70 to the base frame 32. In the example shown, the bolt pattern 32*f* is a NEMA 56C bolt pattern. Other bolt patterns are possible. The base frame is also provided with an elongated opening 32*g*, through which the shaft 122 of the hydraulic pump 120 can extend, and a pair of elongated slots 32*h* for receiving bolts 126 for securing the hydraulic pump 120 to the base frame 32.

The elongated openings 32*g*, 32*h* in the base frame 32 allow for the relative position between the hydraulic pump 120 and motor 70 to be adjusted. As most easily seen at FIGS. 10 and 14, the electric motor 70 is provided with a pulley 74 while the hydraulic pump 120 is provided with a pulley 124. The pulleys 74, 124 are operatively connected to each other by a drive belt 76. To properly tension the belt 76, the hydraulic pump 120 is moved away from the electric motor 70 to an appropriate distance, and then secured to the base frame 32, as facilitated by the elongated openings 32*g*, 32*h*. The elongated openings 32*g*, 32*h* eliminate the need for a belt tensioning idler. Also, and as most easily seen at FIG. 19, the elongated opening 32*g* is provided with a larger diameter opening portion at the end nearest the opening 32*e*. This larger diameter opening allows for the pump 120 to be removed through the opening 32*g* at this location without requiring removal of the pulley 124 from the pump 120.

The base frame 32 is also shown as being provided with openings 32*i* in the sidewalls 32*b*, 32*c* for receiving bolts or another type of fastener that secure the weighted shroud 50 to the base frame 32. The base frame 32 is also provided with a notch 32*k* for facilitating the connection to the front weight assembly 60. The base frame 32 is further provided with openings 32*m* for receiving bolts or another type of fastener that secure the bottom cover 34 to the base frame 32. The bottom cover 34, formed as an open channel from an initially flat sheet of metal (e.g. steel) with an end wall 34*a* and a pair of sidewalls 34*b*, 34*c*, is provided with corresponding openings 34*d* in the sidewalls 34*b*, 34*c*. The base frame 32 is even further provided with a plurality of openings 32*n* for receiving bolts 44 that secure the scraper assembly 40 to the base frame 32.

Referring to FIGS. 14, 16-17 and 33-35, the scraper assembly 40 is shown in further detail. As shown, the scraper assembly 40 includes a cutting head 42 defining a main body 42*a* with a central opening 42*b* for receiving the shaft 72 of the electric motor 70. The shaft 72 can be provided with an eccentric fitting 78 such that, when the shaft 72 rotates, an orbital motion is imparted onto the main body 42*a*. The main body 42*a* is also provided with a plurality of openings 42*c* for receiving bolts 44 that secure the main body 42*a* to the base frame 32 via openings 32*n*. Bushings 46 are provided between the main body 42*a* and the base frame 32 to enable the main body 42*a* to be movable relative to the base frame 32, to limit the degree of orbital or eccentric movement, and to also isolate vibration. Notably, the openings 32*n* in the base frame are configured to alternatively receive a reciprocating guide structure for the cutting assembly 40 such that the cutting assembly moves in a reciprocating pattern instead of an orbital pattern. One such reciprocating guide structure is shown and described in U.S. Pat. No. 4,963,224 issued on Oct. 16, 1990, the entirety of which is incorporated by reference herein. Thus, the same machine 10 can be adapted for orbital or reciprocating blade operation, which is not a capability of typical prior art machines.

The cutting head 42 also includes a pair of openings 42*e* on opposite sides of the opening 42*b* which align with corresponding openings 49*a* of the flange bearing 49 to the cutting head 42 such that the flange bearing 49 can be bolted to the cutting head 42. When assembled, the eccentric fitting 78 is received in the central opening 49*b* of the flange bearing 49. In one example, the flange bearing 49 is a 2-bolt flange bearing with a type 206 housing, as shown at FIG. 39. Other types of flange bearings may be used, such as a 4-bolt flange bearing.

As shown, the main body 42*a* of the cutting head 42 extends to a nose portion 42*d* which bends at an oblique angle to the main body 42*a* and supports a scraper blade (not shown) clamped between the cutting head 42 and a cover plate 48. The cover plate 48 is removably bolted to the nose portion 42*d* via fasteners and openings 42*e* such that the blades can be easily changed. The scraper blades are a consumable component that can be replaced when worn. Also, the cutting head 42 and cover plate 48 can support differently configured scraper blades such that the machine 10 can be ideally arranged to suit a particular job application (e.g. vinyl floor removal, carpet removal, etc.). In one aspect, the cutting head 42 can be provided with a recessed area 42*f* with a back-up ledge 42*g* for respectively holding the blade and providing a stop against which the blade can abut during operation.

Referring to FIGS. 16-17 and 24-27, the weighted shroud 50 is shown in further detail. As shown, the weighted shroud 50 includes a shroud 52 and one or more weights 54 attached to the shroud 52. In the example shown, a single weight 54 is welded to the shroud 52. The shroud 52 protects the components supported by or near the base frame 32, such as the hydraulic pump 120, hoses and fittings, and the control components of the electric motor 70. The weight 54 adds weight to the machine 10 to provide the machine 10 with traction. In one aspect, the shroud 52 is formed from a single sheet of metal (e.g. steel) to have an end wall 52*a* and a pair of sidewalls 52*b*, 52*c*. The sidewalls 52*b*, 52*c* are provided with slots or openings 52*d* which enable fasteners, such as bolts, to be used to secure the shroud 52 to the base frame 32 via openings 32*m* in the base frame 32. The weight 54 is attached to the end wall 52*a* of the shroud 52 and generally has the same perimeter shape as the end wall 52*a*. The shroud can include pins or other support structures such that additional weights can be removably added to the top and sides of the shroud 52 to suit a particular application.

In one aspect, the end wall 52*a* and the weight 54 can be provided with respective slots or openings 52*e*, 54*a* for receiving a fastening system including a bolt 56 that connects to a lug 22*h* located on the first part 22 of the tank-frame assembly 20. The bolt 56 connected to the lug 22*h* can be most easily seen at FIG. 10. This arrangement imparts significant strength to the overall structure, as the shroud 52 functions as a gusset or truss support member between the tank-frame assembly 20 and the base frame 32.

Referring to FIGS. 16-17 and 28-32, the front weight assembly 60 is shown in further detail. The front weight assembly 60 adds additional weight to the front of the machine 10 to better suit a particular application. The front weight assembly 60 is shown as including a mounting bracket 62 and a front weight 64. The mounting bracket 62 is formed as a metal block (e.g. water jet cut steel), and includes a pair of slots 62*a* at each end. The slots 62*a* receive the portions of the base frame end wall 32*a* that extend past the recess area 32*k*. The mounting bracket 62 has a lesser width below the slots 62*a* such that the lower ends 62*b* of the mounting bracket 62 fit within the sidewalls 32*b*, 32*c* of the base frame 32. At the location of the slots 62*a* and recess or notch 32*k*, and all other points of contact, the mounting bracket 62 can be welded to the base frame 32. This arrangement imparts considerable strength to the resulting structure and thus increases the capacity, durability, and performance of the machine 10. In one aspect, the chassis of the machine 10 can be characterized as also including the mounting bracket 62. The mounting bracket includes a pair of openings or through holes 62*c* for receiving fasteners, such as bolts or screws, to removably secure the front weight 64 to the mounting bracket 62.

As shown, the front weight 64 includes a base member 64*a* to which a front plate 64*b* and a rear plate 64*c* are attached. The plates 64*b*, 64*c* can be separately machined and attached to the base member 64*a* or can be molded onto the base member 64*a*. The base member 64*a* and plates 64*b*, 64*c* are formed from steel, in one example. In one aspect, the base member 64*a* is provided with a pair of openings 64*d* that allow bolts or screws passing through the mounting bracket openings 62*c* to be received. In one example, the openings 64*d* are threaded openings. The base member 64*a* can also include a handle portion 64*e* to allow a user to more easily handle the front weight 64. It is noted that front weights 64 of different weights can be mounted to the mounting bracket 62 such that the machine 10 can be configured with a desired amount of weight to suit a particular application.

Figure 40:
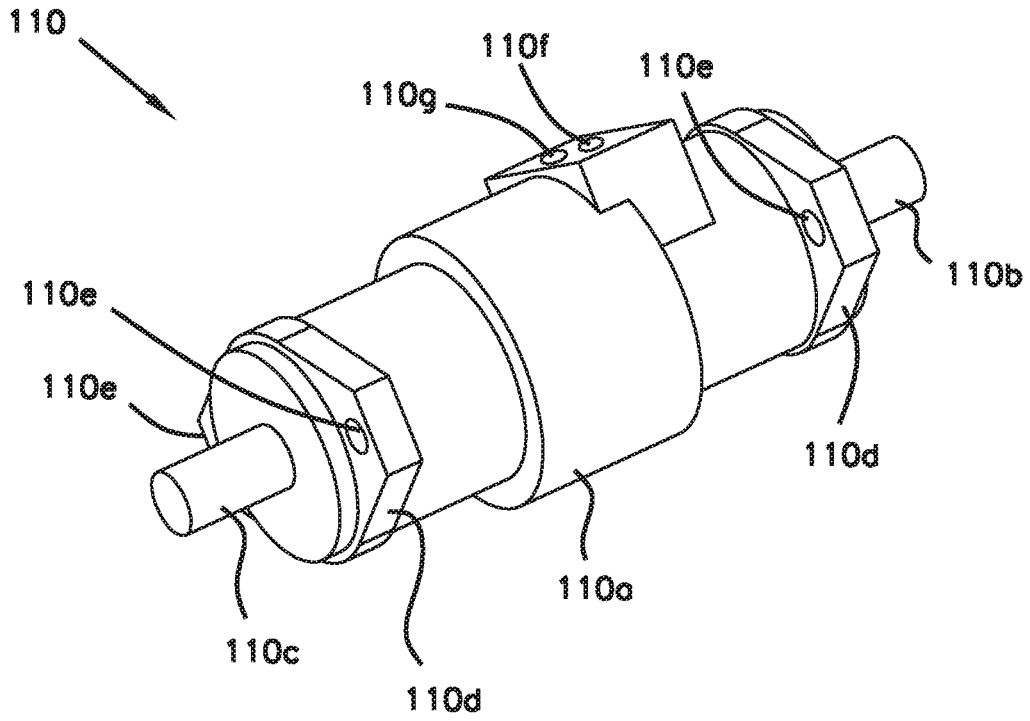
FIG. 40 is a perspective view of the hydraulic motor of the floor scraper machine shown in FIG. 1.
Figure 41:
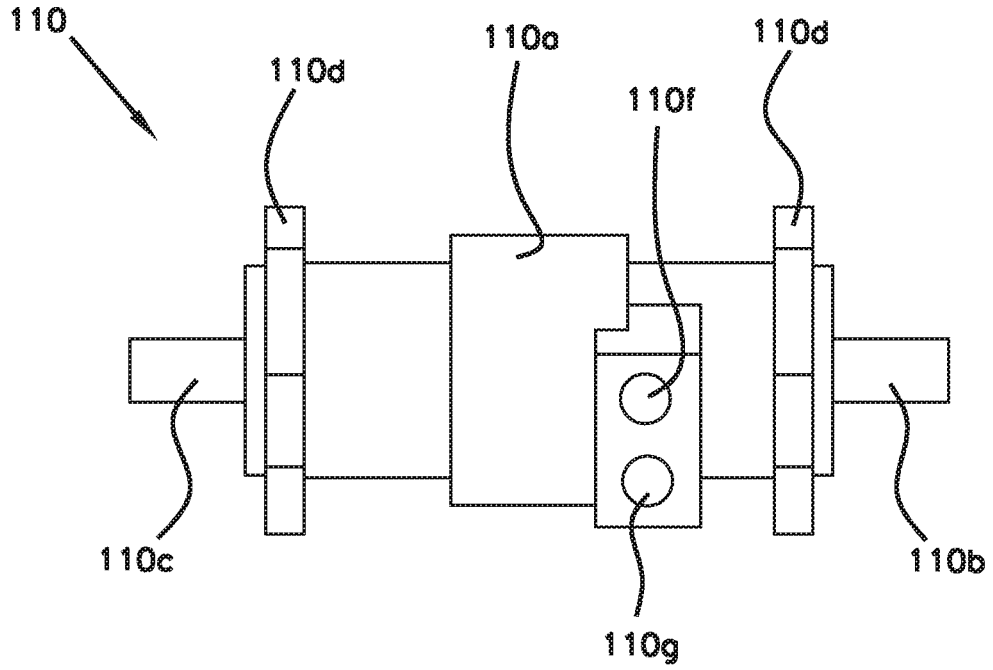
FIG. 41 is a top view of the hydraulic motor shown in FIG. 40.

Referring to FIGS. 40 and 41, the hydraulic motor 110 is shown in isolation. In the example shown, the hydraulic motor 110 includes a motor body 110*a* housing a hydraulic drive assembly. In the example shown, the internal hydraulic drive assembly is a geroler assembly (e.g. star, rollers, geroler plate/body which can be integral with motor body 110*a*) of the type generally known in the art. In one aspect, the hydraulic drive assembly is connected to and drives a first drive axle 110*b* and a second drive axle 110*c*. The first and second drive axles 110*b*, 110*c* can be connected (e.g. via welding) together within the motor body 110*a*. As can be most easily seen at FIGS. 3, 4, and 9, the drive axles 110*b*, 110*c* are directly connected to the wheels 12 such that both wheels 12 are simultaneously driven by the hydraulic motor 110 and such that the drive axles 110*b*, 110*c* are coaxial with the axis of rotation of the wheels 12. In one aspect, the hydraulic motor 110 is also provided with a pair of mounting flanges 110*d* with openings 110*e* that align with the openings 22*e* on the tank-frame assembly 20 such that fasteners (e.g. bolts, screws, etc.) can be used to mount the hydraulic motor 110 to the tank-frame assembly 20. The motor body 110*a* is also provided with first and second ports 110*f*, 100*g* for allowing pumped and returned fluid to respectively enter and exhaust from the internal hydraulic drive assembly.

Figure 11:
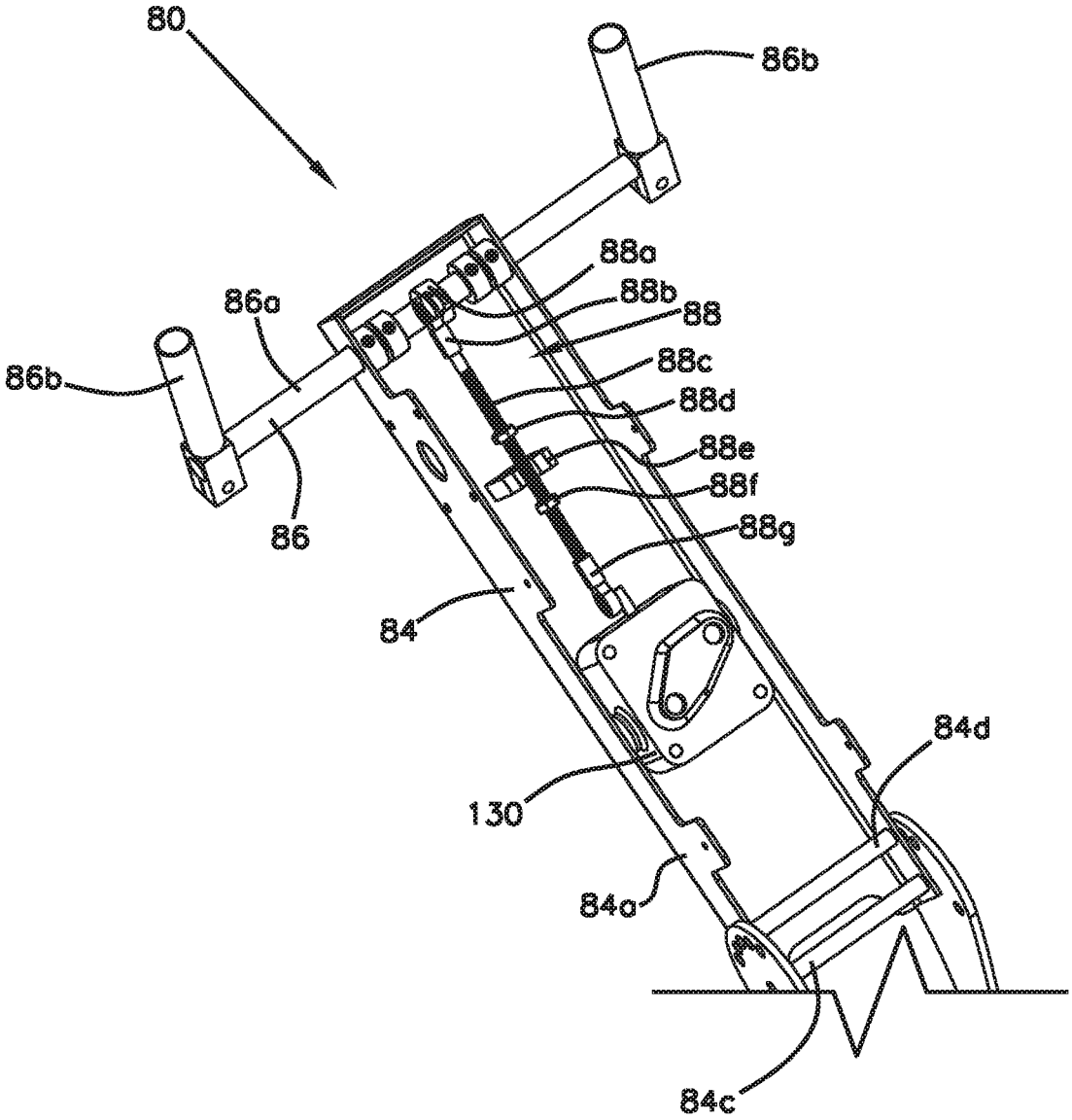
FIG. 11 is a partial perspective view of the handle assembly of the walk-behind floor scraper machine shown in FIG. 1.
Figure 12:
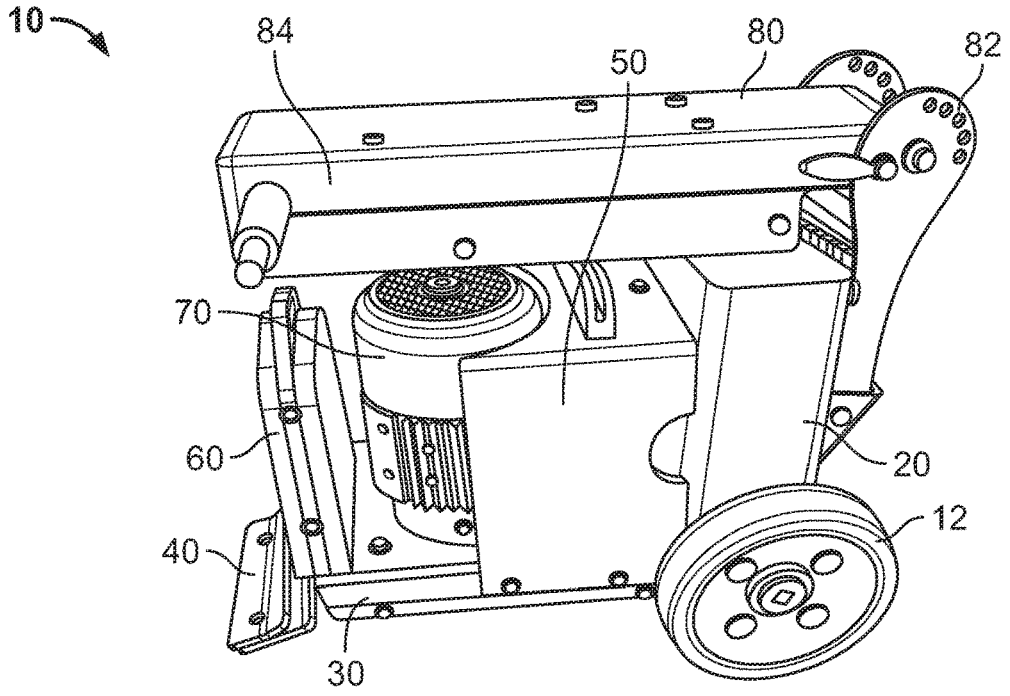
FIG. 12 is a perspective view of the walk-behind floor scraper machine of the type shown in FIG. 1, with the machine being shown in a folded position.
Figure 13:
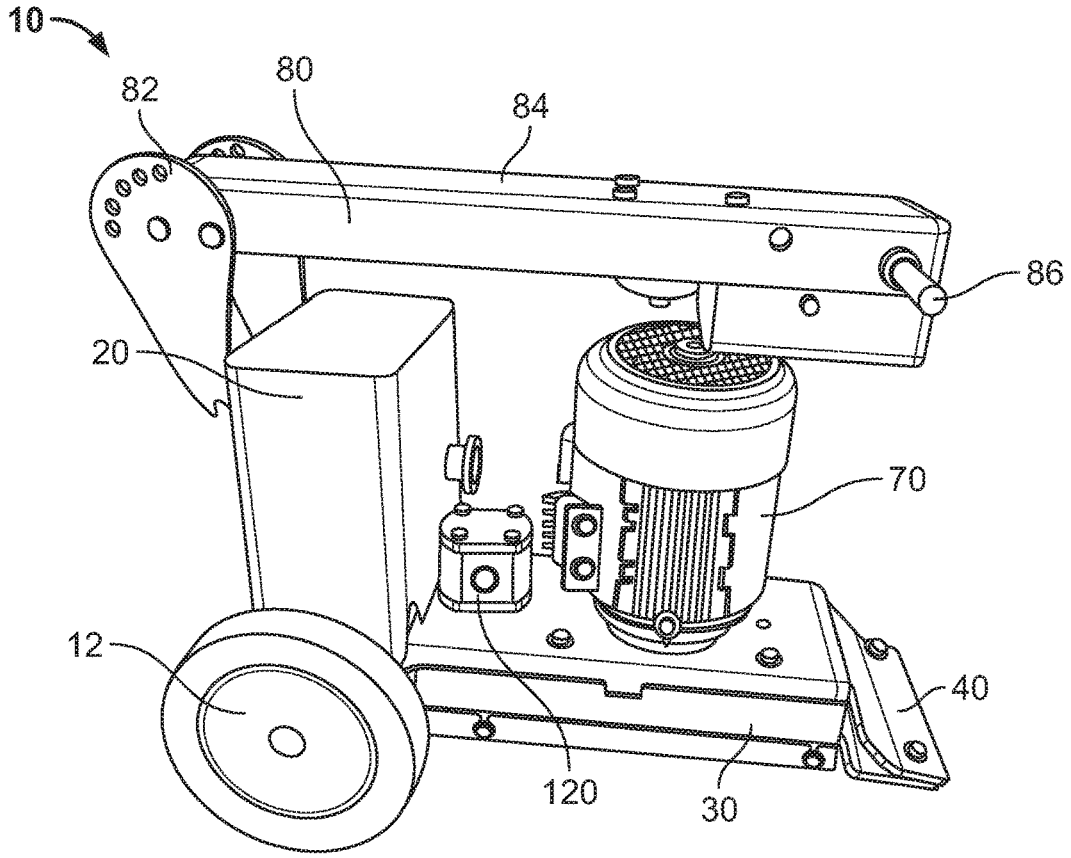
FIG. 13 is a perspective view of the walk-behind floor scraper machine of the type shown in FIG. 1, with the machine being shown in a folded position and with a front weight assembly and a shroud assembly of the machine being removed.
Figure 14:
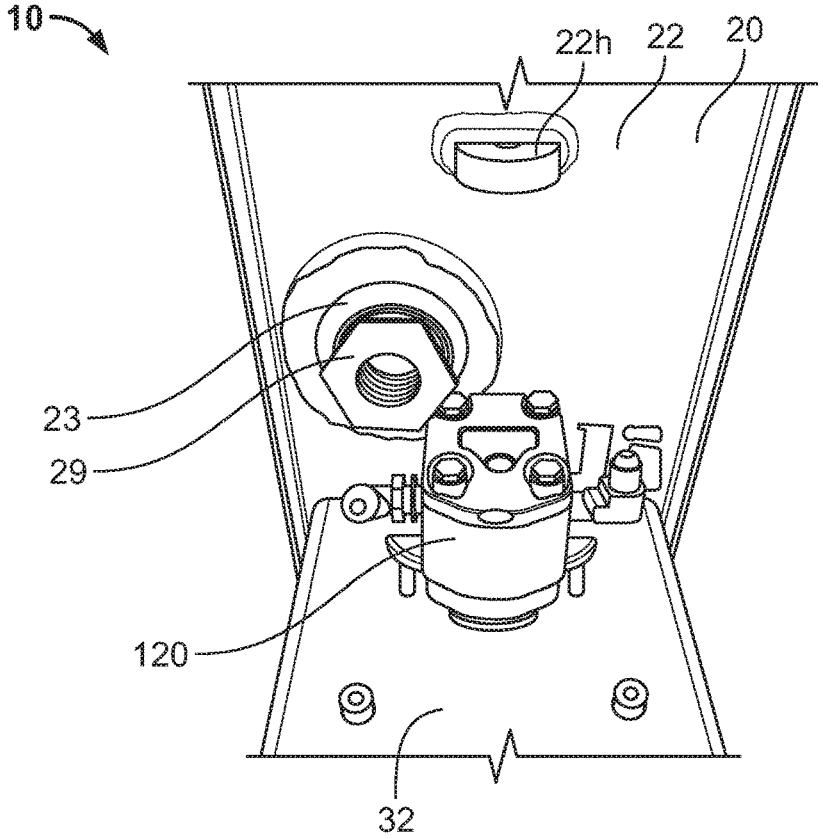
FIG. 14 is a partial perspective view of a top portion including a hydraulic pump of the walk-behind floor scraper machine shown in FIG. 13.
Figure 15:
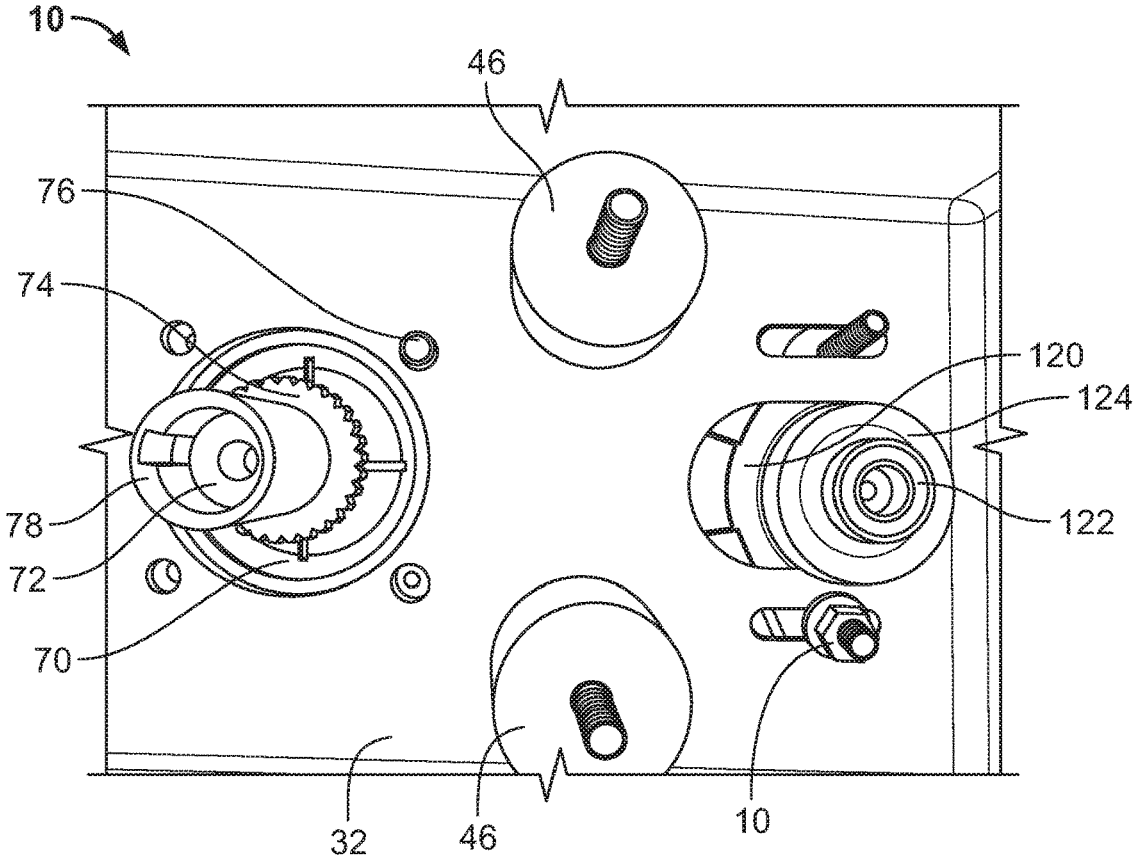
FIG. 15 is a partial perspective view of a bottom portion of the walk-behind floor scraper machine shown in FIG. 13.
Figure 16:
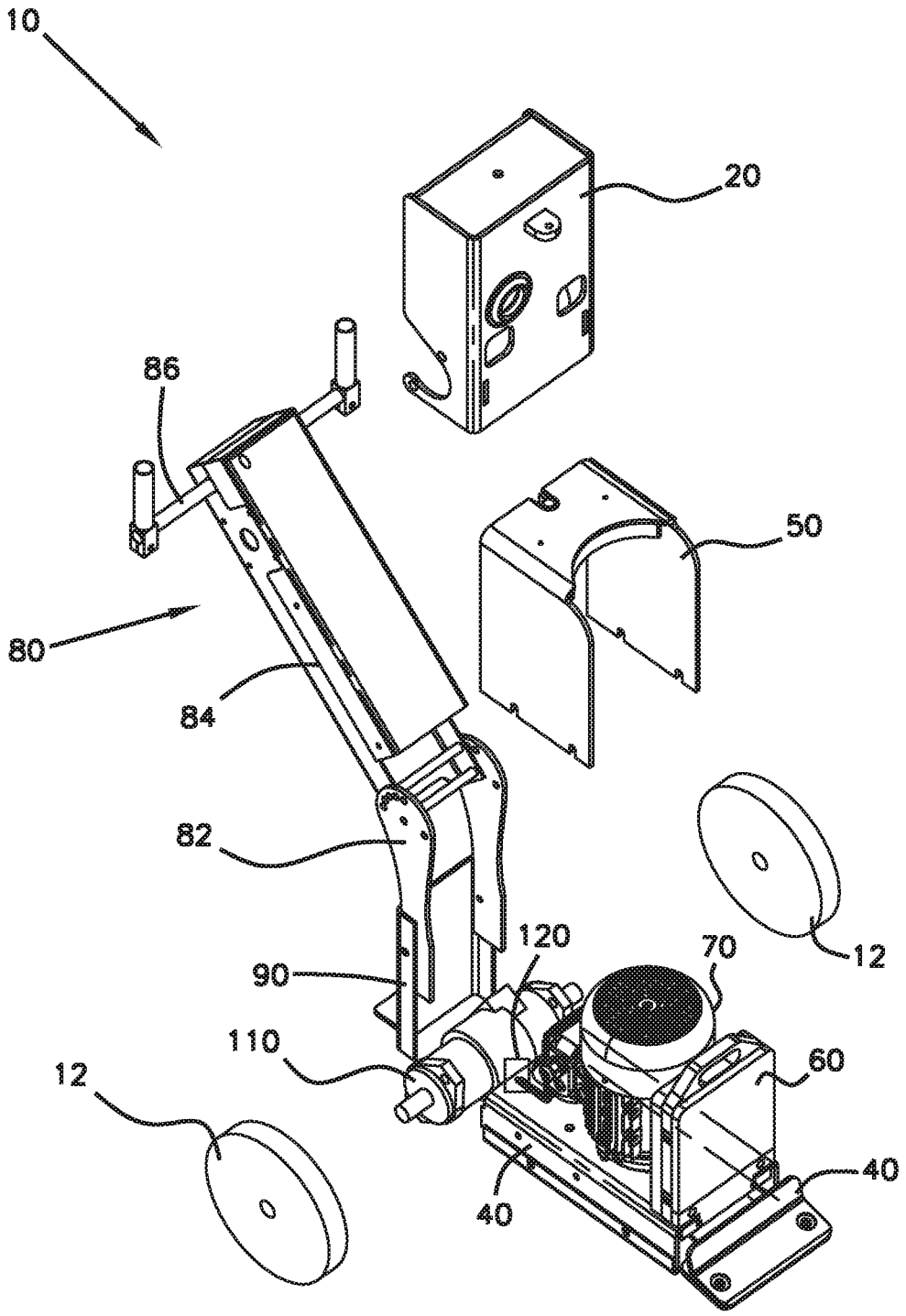
FIG. 16 is an exploded front top perspective view of the walk-behind floor scraper machine shown in FIG. 1.
Figure 17:
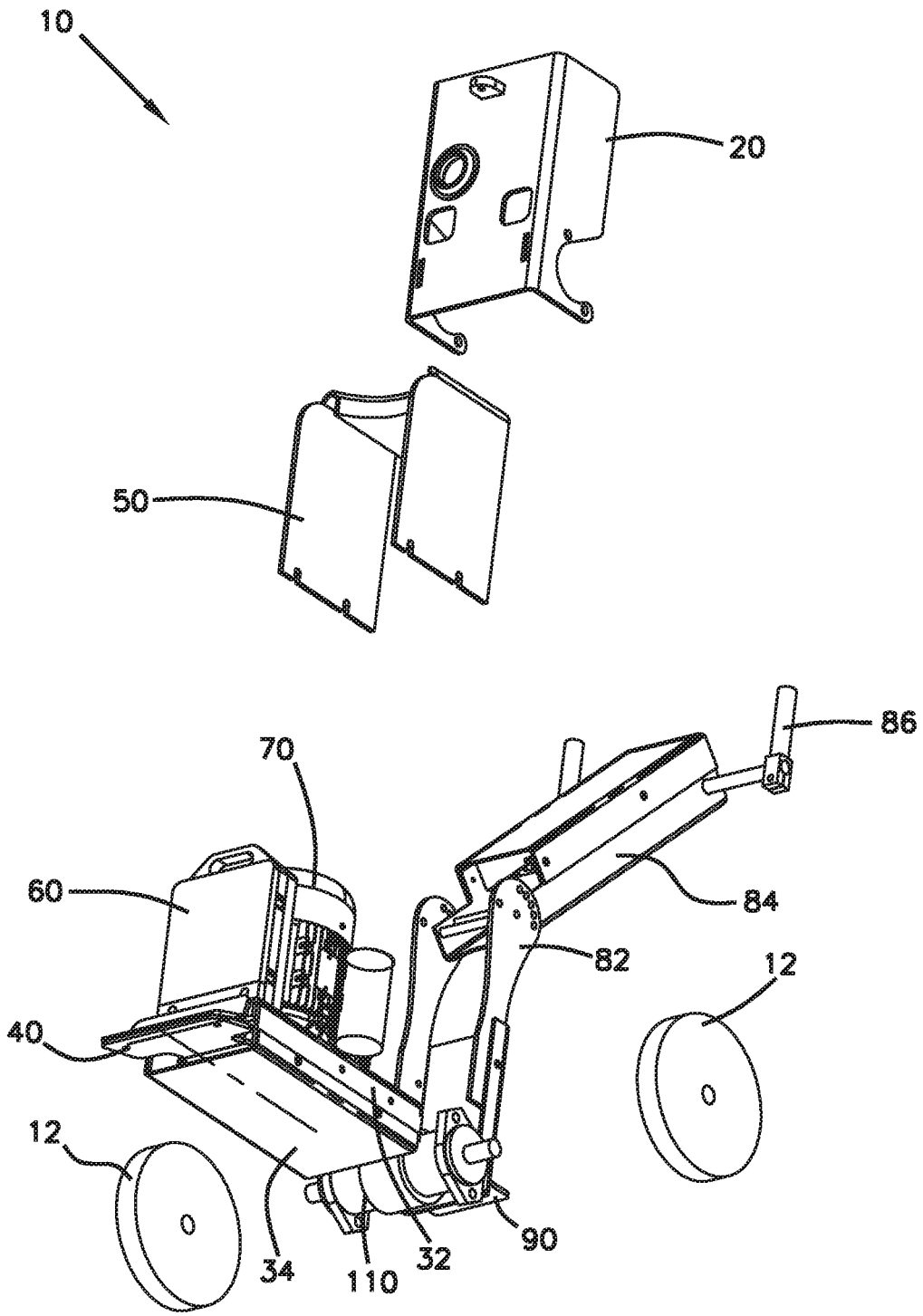
FIG. 17 is an exploded front bottom perspective view of the walk-behind floor scraper machine shown in FIG. 1.
Figure 18:
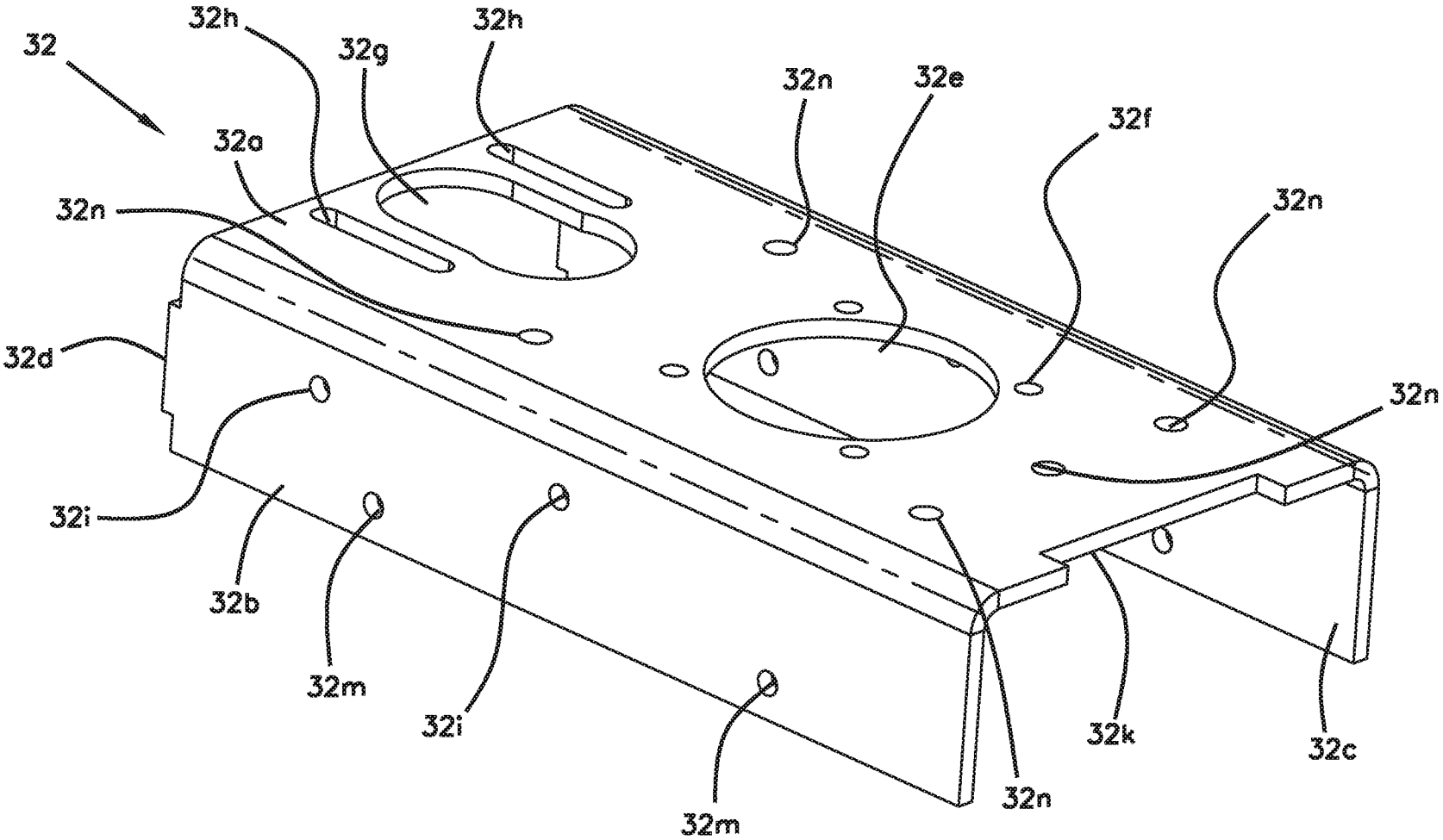
FIG. 18 is a perspective view of a base frame member of the walk-behind floor scraper machine shown in FIG. 1.
Figure 19:
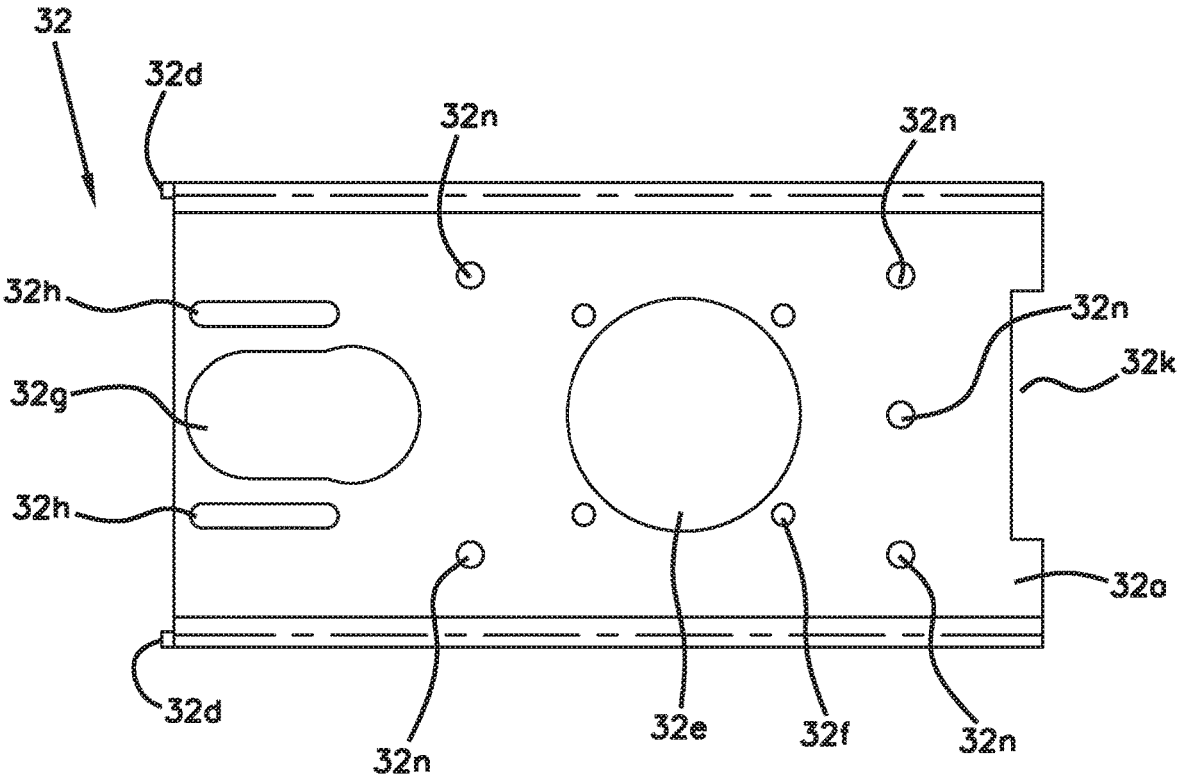
FIG. 19 is a top view of the base frame member shown in FIG. 18.
Figure 20:
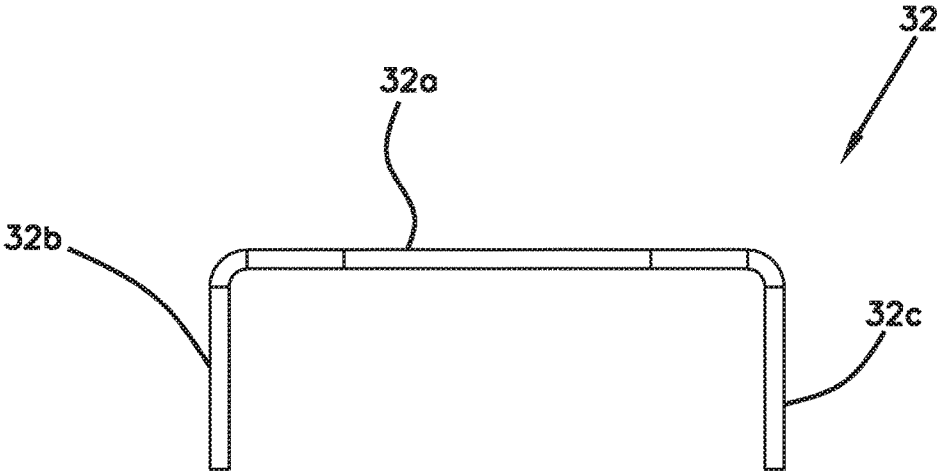
FIG. 20 is a front end view of the base frame member shown in FIG. 18.
Figure 21:
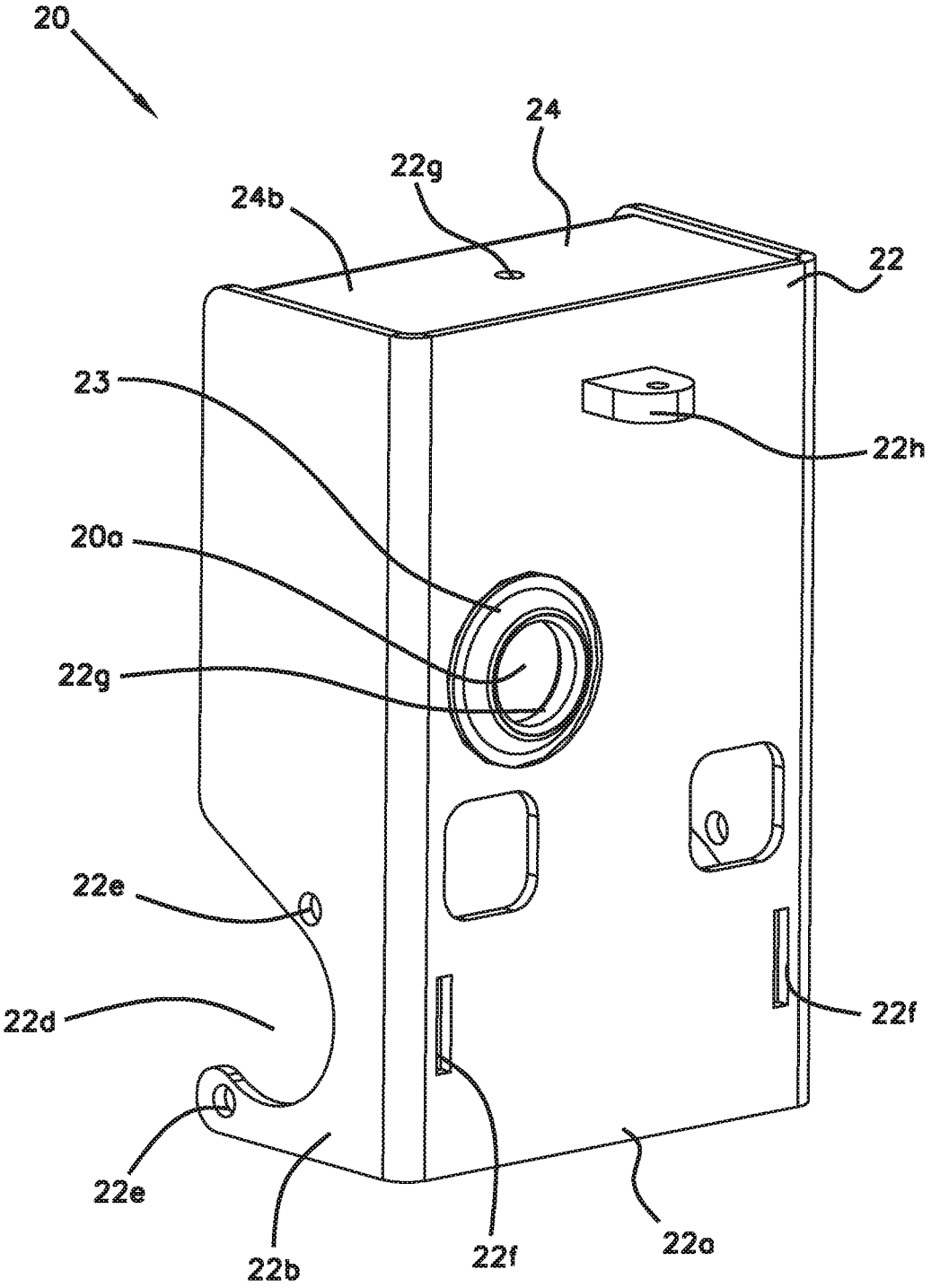
FIG. 21 is a front perspective view of a tank-frame assembly of the walk-behind floor scraper machine shown in FIG. 1.
Figure 22:
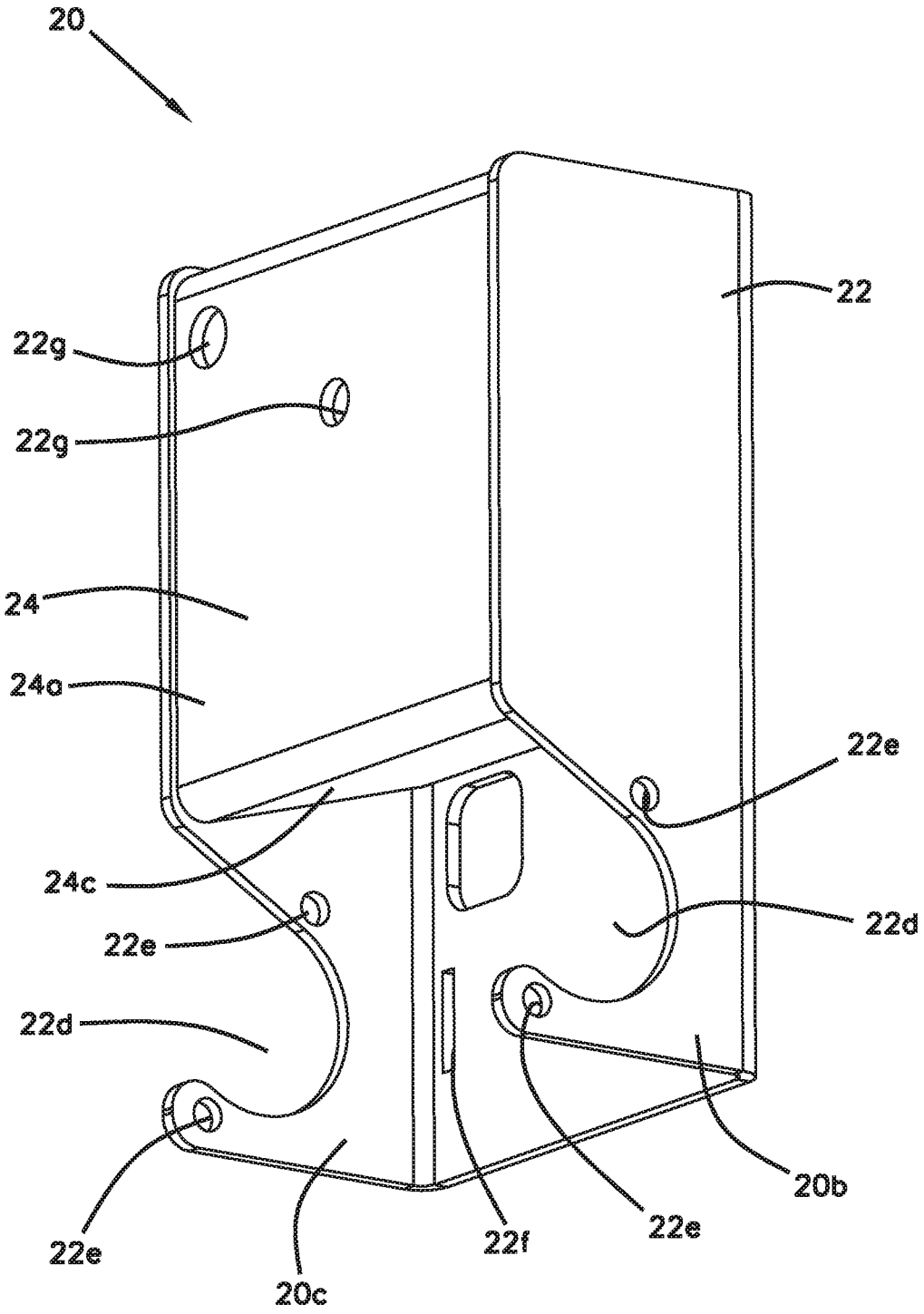
FIG. 22 is a rear perspective view of the tank-frame assembly shown in FIG. 21.
Figure 23:
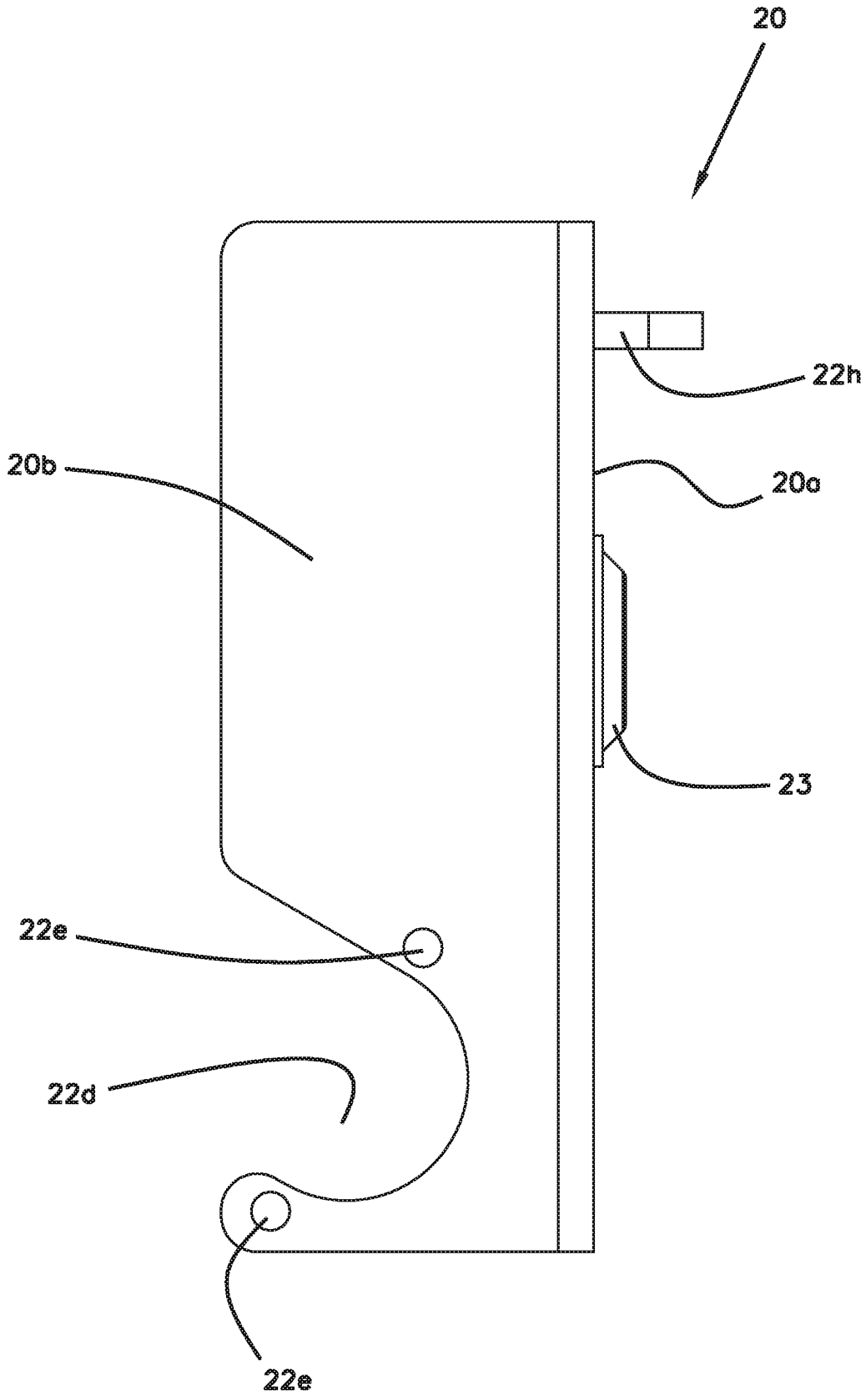
FIG. 23 is a side view of the tank-frame assembly shown in FIG. 21.
Figure 25:
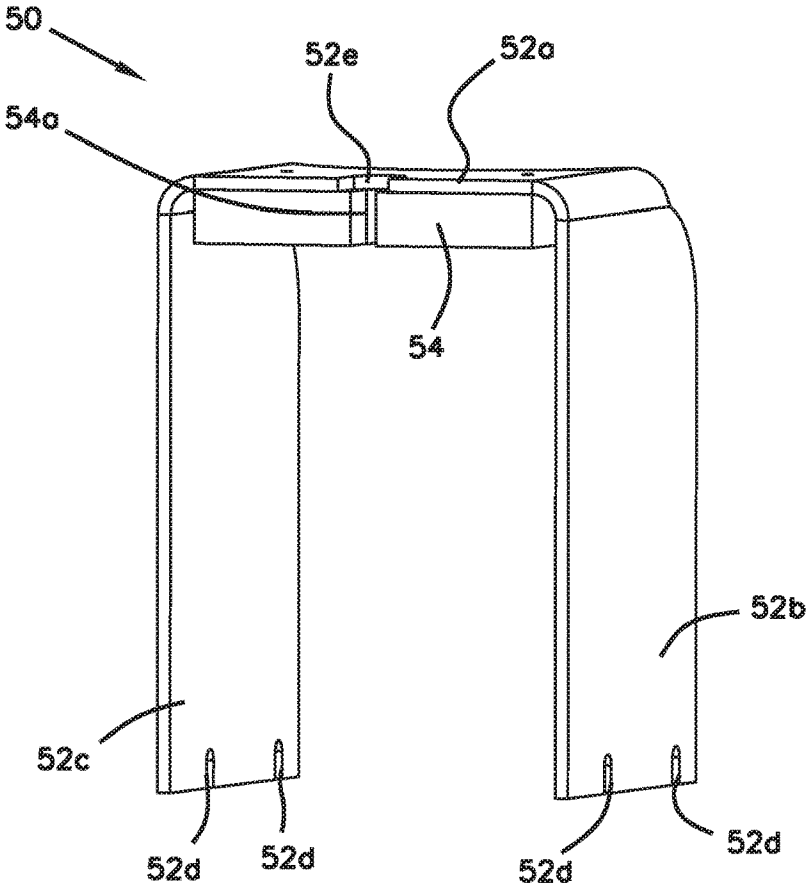
FIG. 25 is a rear bottom perspective view of the shroud assembly shown in FIG. 24.
Figure 24:
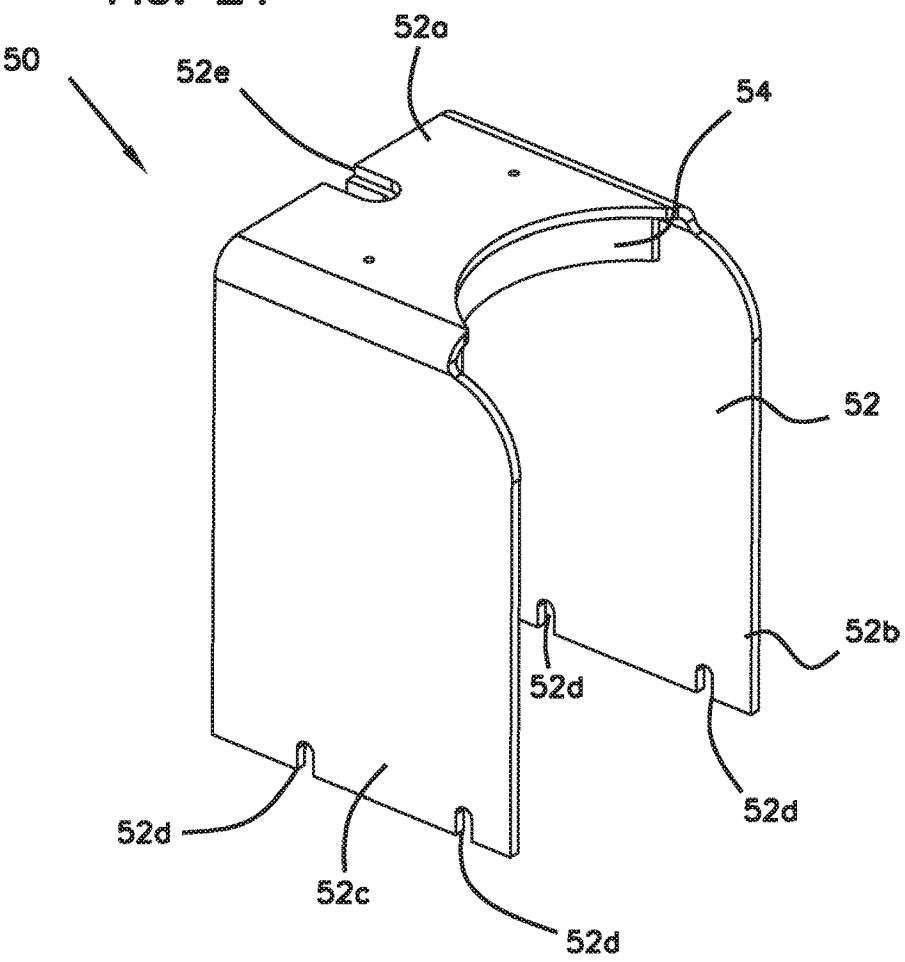
FIG. 24 is a front top perspective view of a shroud assembly of the walk-behind floor scraper machine shown in FIG. 1.
Figure 27:
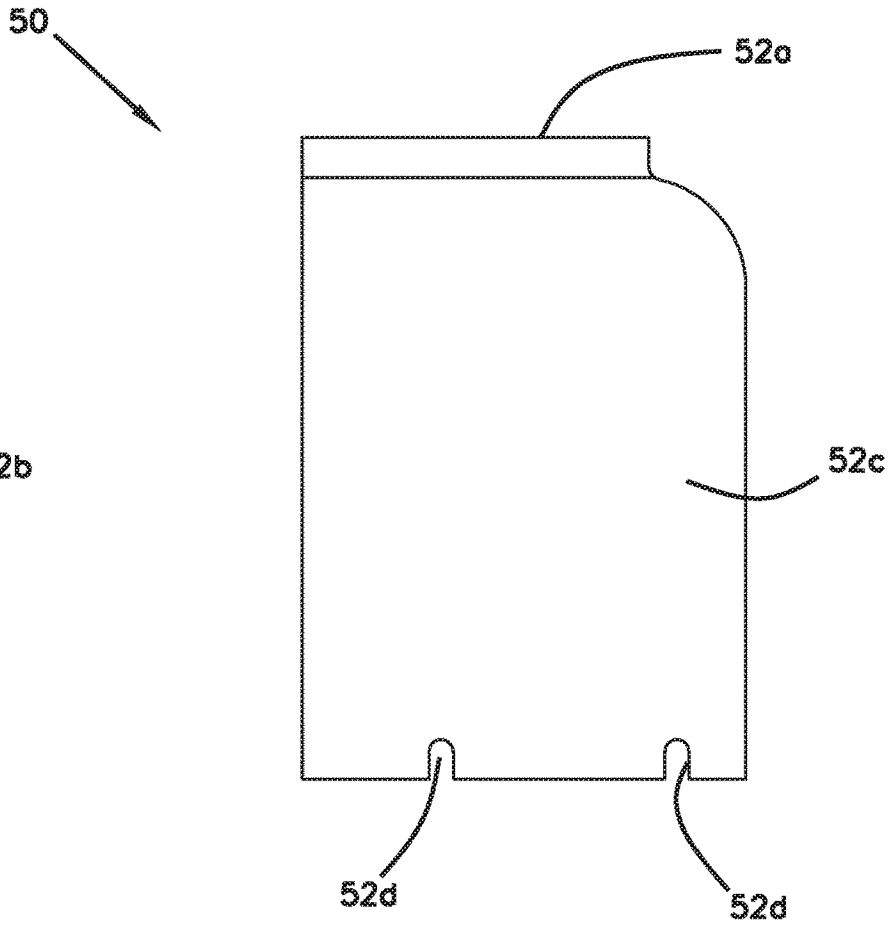
FIG. 27 is a side view of the shroud assembly shown in FIG. 24.
Figure 26:
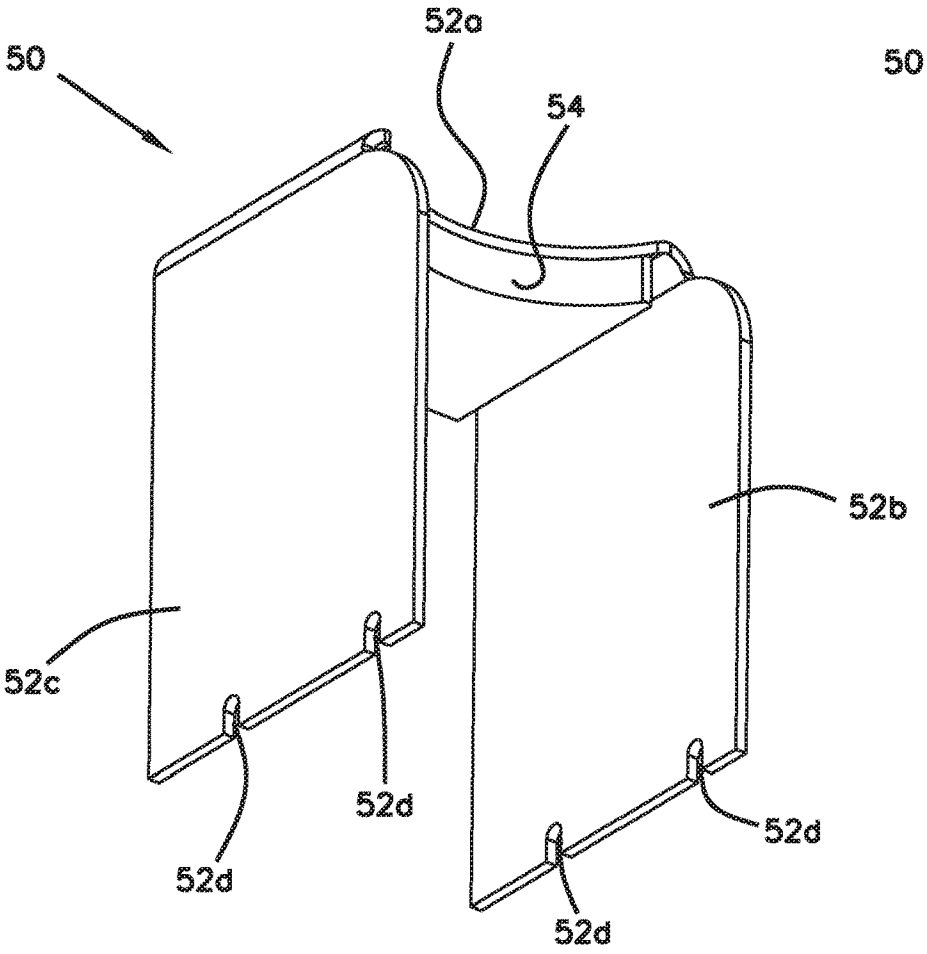
FIG. 26 is a front bottom perspective view of the shroud assembly shown in FIG. 24.
Figure 28:
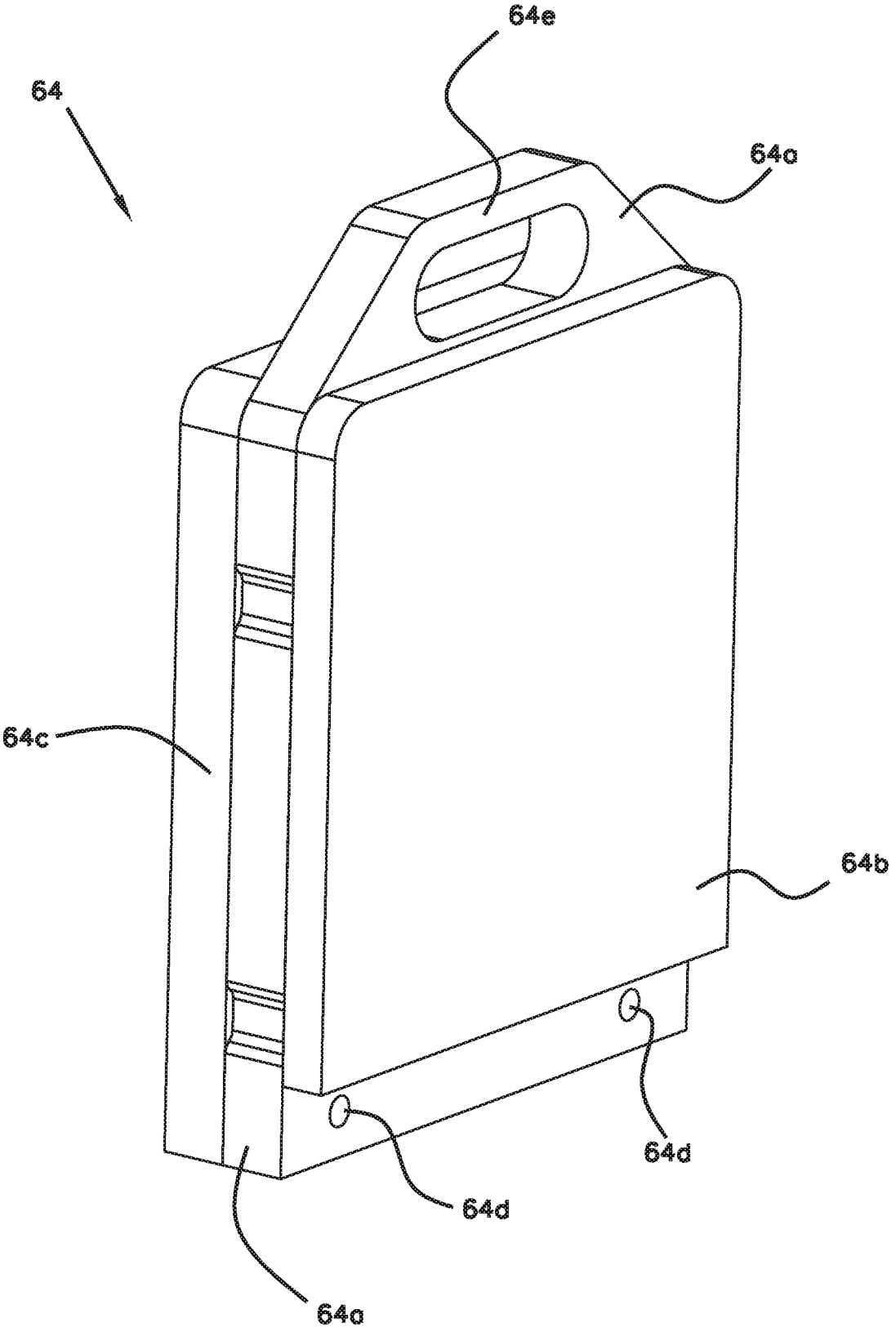
FIG. 28 is a front perspective view of a front weight assembly of the walk-behind floor scraper machine shown in FIG. 1.
Figure 29:
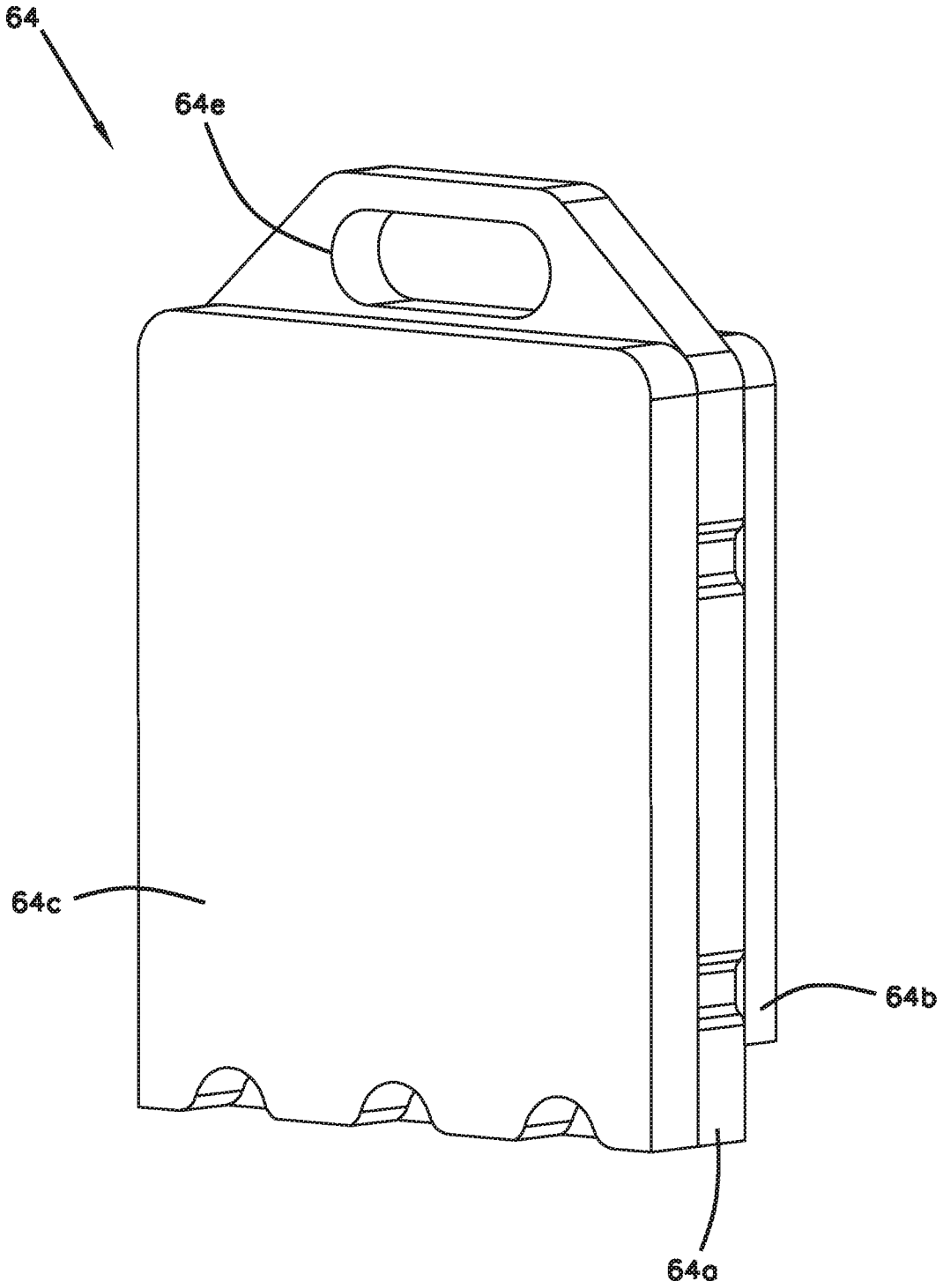
FIG. 29 is a rear perspective view of the front weight assembly shown in FIG. 28.
Figure 30:
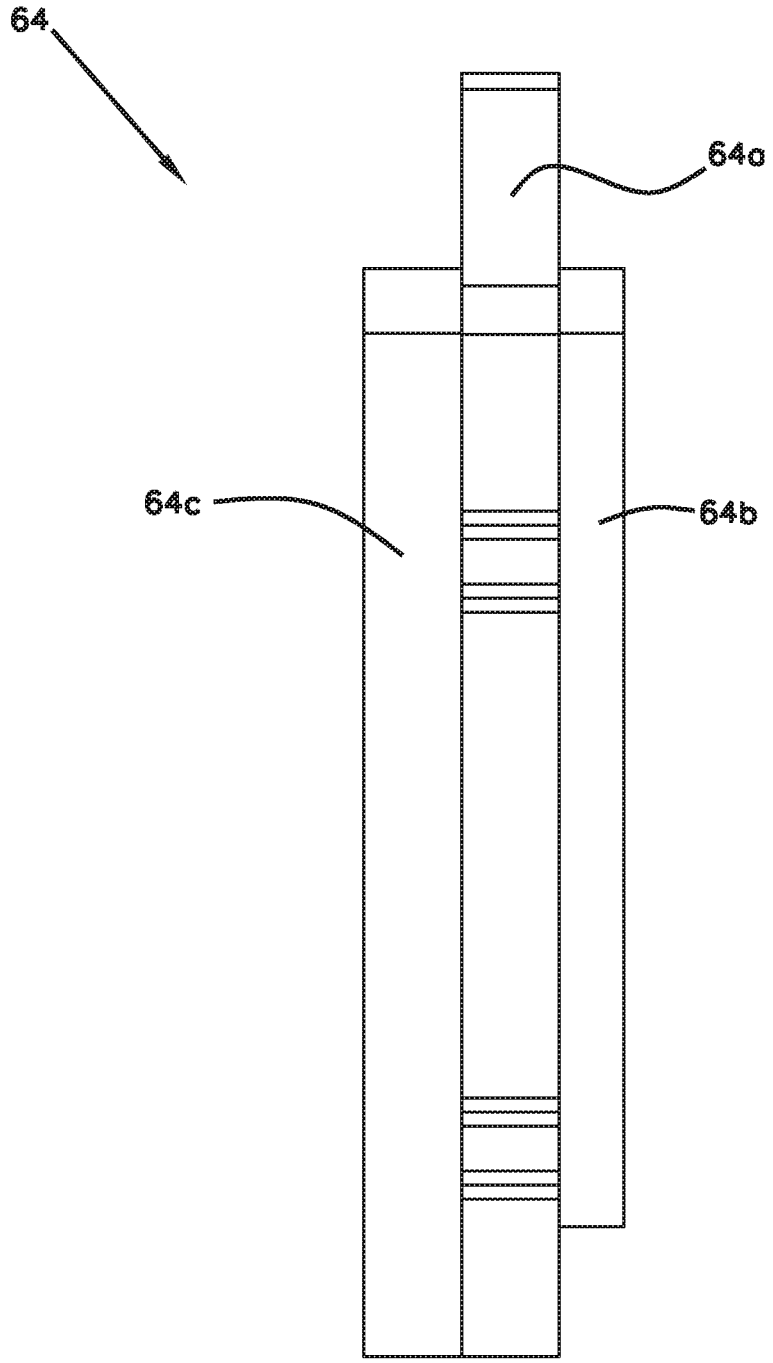
FIG. 30 is a side view of the front weight assembly shown in FIG. 28.
Figure 31:
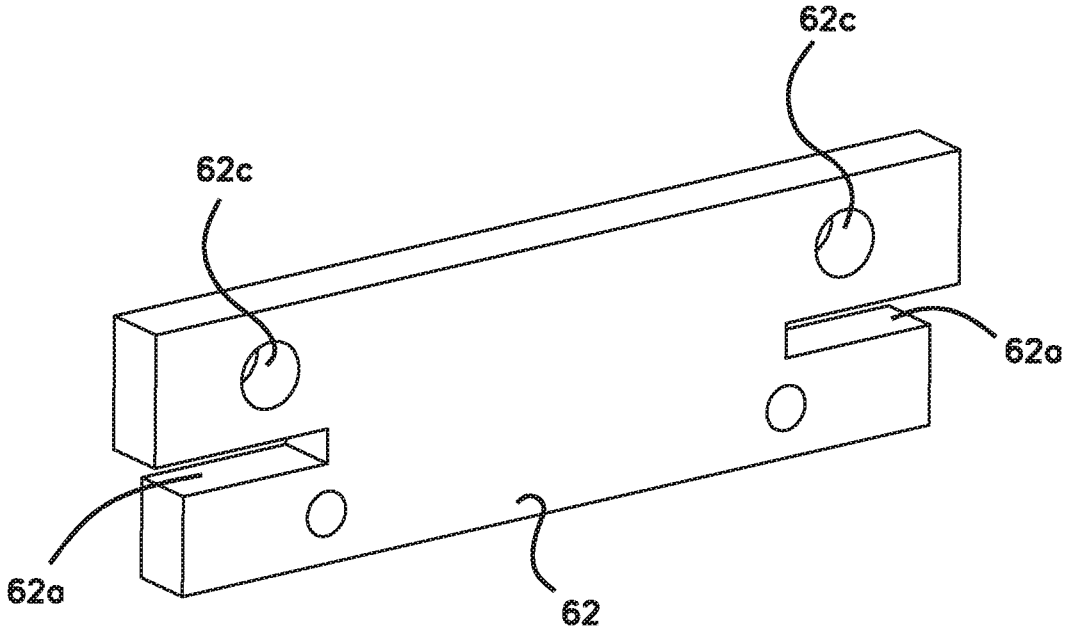
FIG. 31 is perspective view of a mounting bracket for securing the front weight assembly shown in FIG. 28 to the base frame member shown in FIG. 18.
Figure 32:
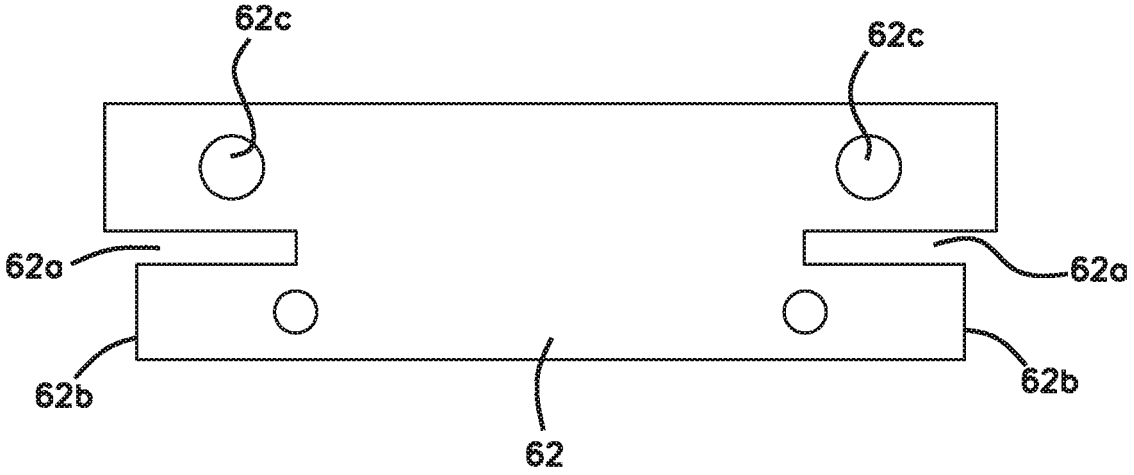
FIG. 32 is a front view of the mounting bracket shown in FIG. 31.
Figure 33:
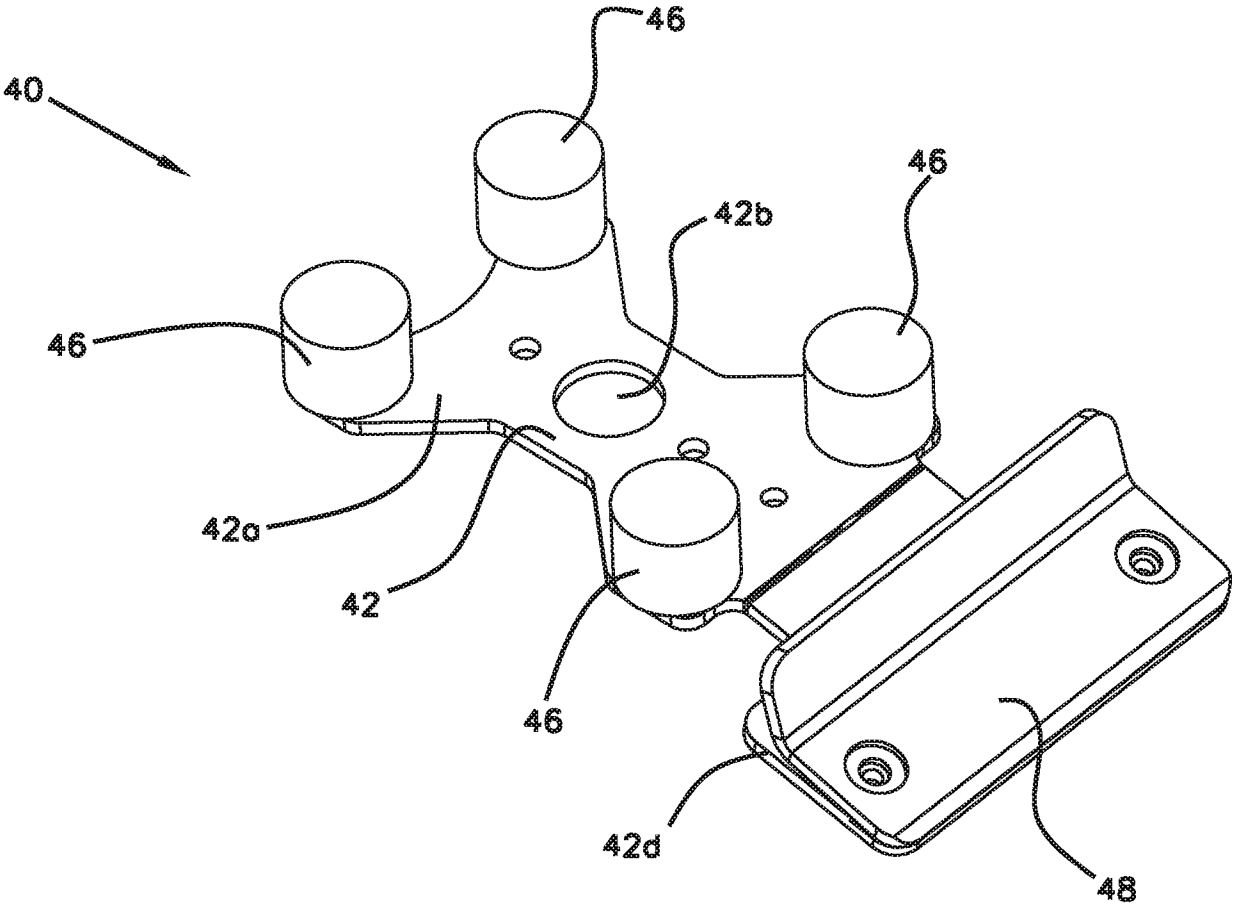
FIG. 33 is a top front perspective view of a scraper assembly of the walk-behind floor scraper machine shown in FIG. 1.
Figure 34:
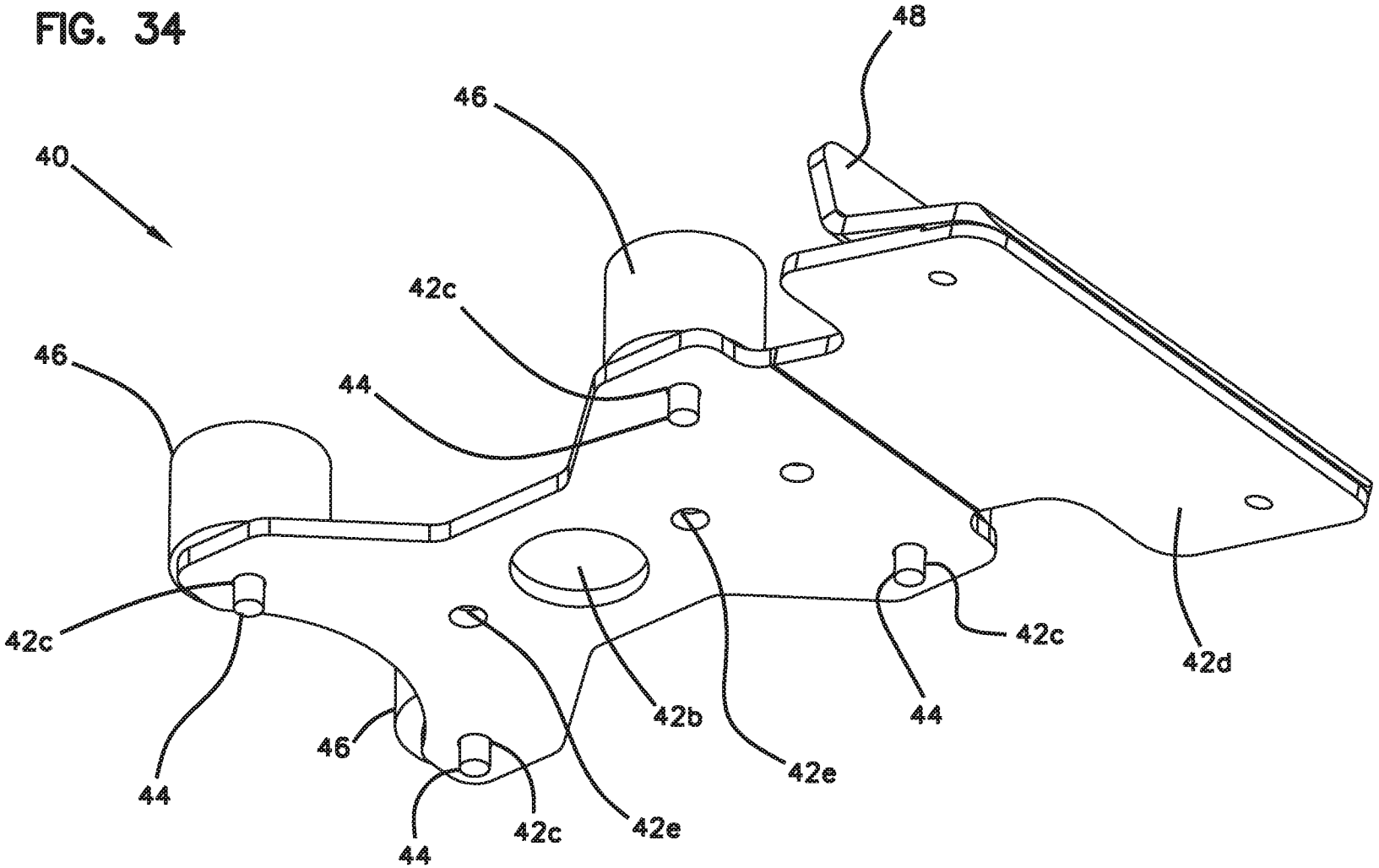
FIG. 34 is a bottom front perspective view of the scraper assembly shown in FIG. 33.
Figure 35:
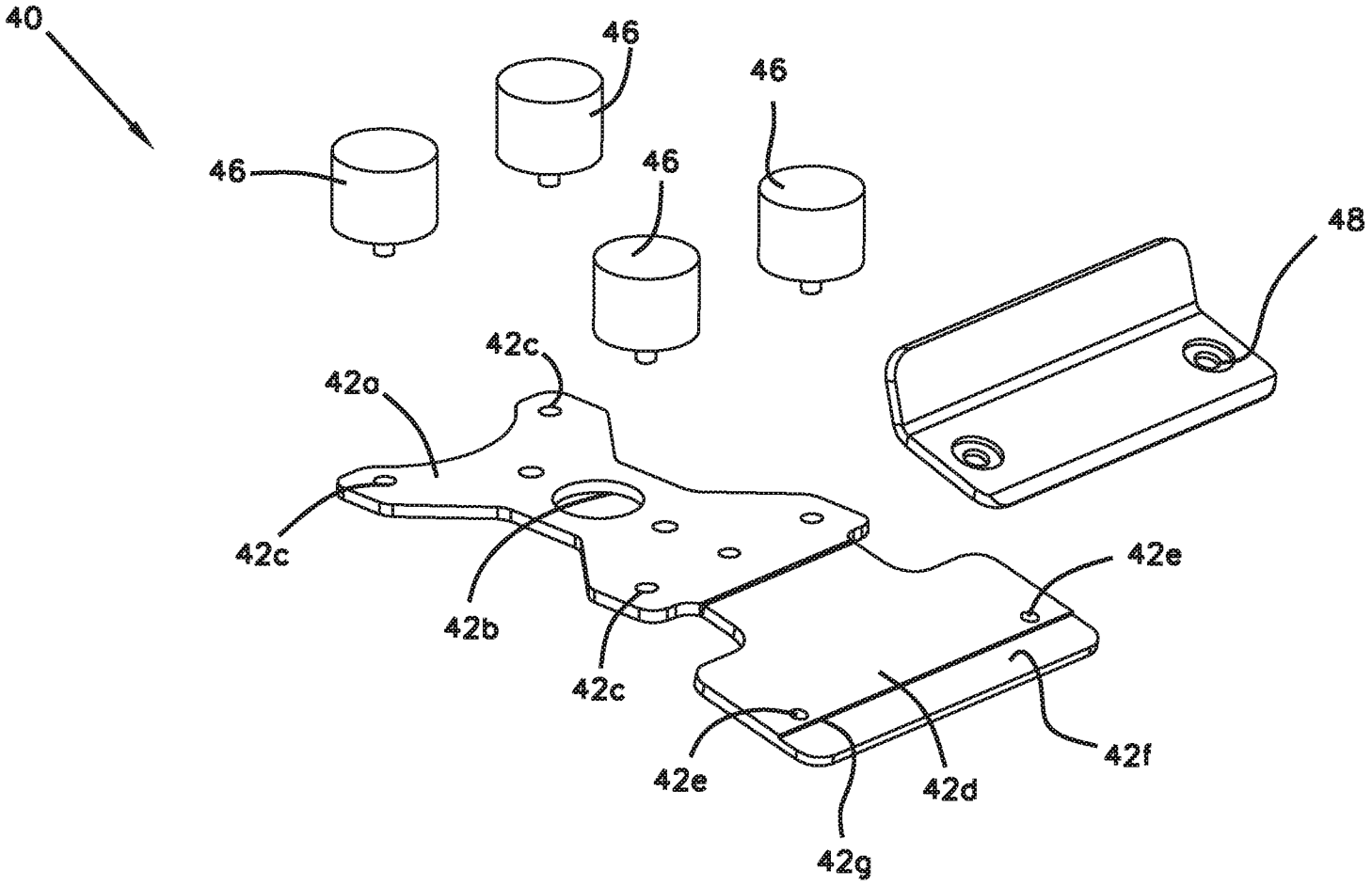
FIG. 35 is a top front perspective exploded view of the scraper assembly shown in FIG. 33.
Figure 36:
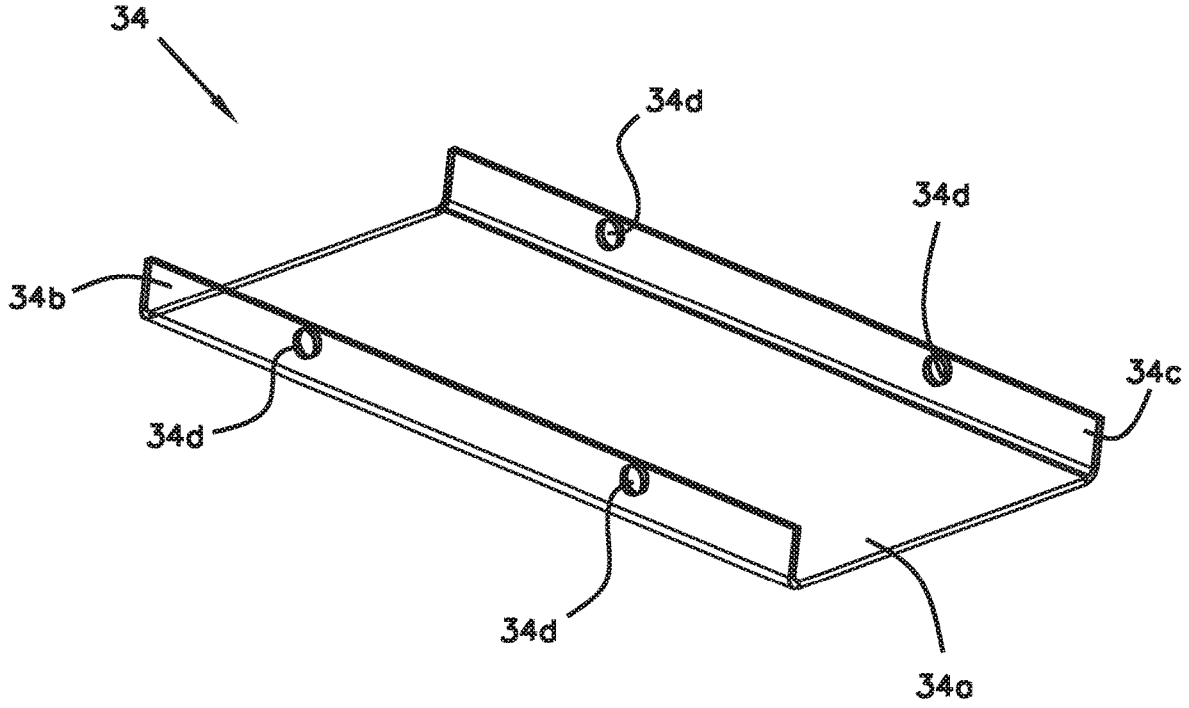
FIG. 36 is a top perspective view of a bottom cover of the walk-behind floor scraper machine shown in FIG. 1.
Figure 37:
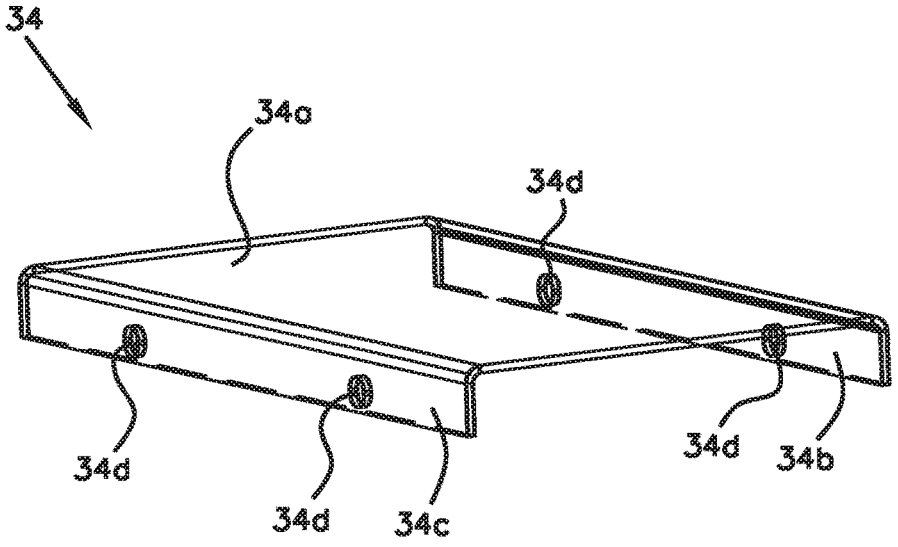
FIG. 37 is a perspective view of the bottom cover shown in FIG. 36.
Figure 38:
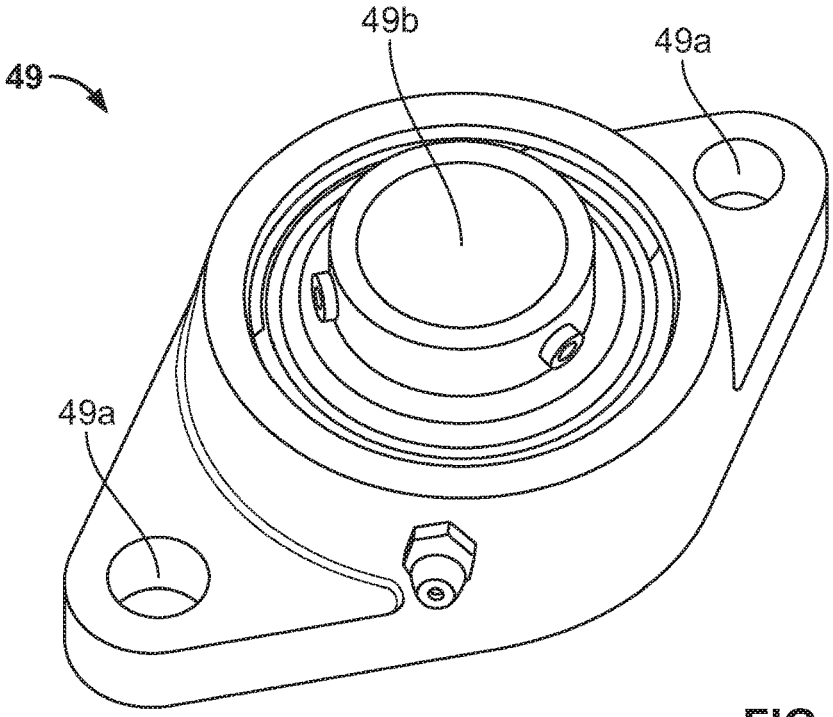
FIG. 38 is a perspective view of a flange bearing of the scraper assembly shown in FIG. 33.

Referring to FIGS. 10, 13-15, and 38-39, details of the hydraulic system 100 are shown in further detail. As stated previously, the hydraulic system 100 can be provided with a hydraulic motor 110, a hydraulic pump 120, and a control valve 130. A physical configuration of the hydraulic pump 120 is depicted at FIGS. 14 and 15 showing a gear-type pump while a physical configuration of the control valve 130 is depicted at FIG. 11 showing a spool and sleeve, cartridge type valve. Referring to FIG. 41, a corresponding schematic showing the use of these components in the hydraulic system 100 and the associated interconnecting hoses or lines is presented. In the example shown, the hydraulic system 100 further includes a relief valve 102 between the pump 120 and the tank 20 to bypass flow from the pump 120 to the tank 20 when excess pressures exist. A check valve 104 is also provided to prevent reverse flow from the valve 130 through the relief valve 102.

In the configuration shown, the control valve 130 is a manually operated three-way, three position spool/sleeve type cartridge valve with centering springs. The position of the control valve 130 can be effectuated through hydraulic lines or by direct mechanical means, such as an attached lever or cables. In the embodiment shown, the position of the control valve 130 is effectuated by rotational movement of the handles 86*b* and bar 86*a*. In the neutral, center position C, the valve 130 places the pump 120 in fluid communication with the tank 20 such that no fluid flow is delivered to the hydraulic motor 110. In this position, fluid to and from the pump 120 and motor 110 are blocked through the valve. In a first position A, the valve 130 places a first side 110*f* of the hydraulic motor 110 in fluid communication with the pump 120 and a second side 110*g* of the motor 110 in fluid communication with the tank 20 such that the hydraulic motor is driven in a first rotational direction associated with forward movement of the machine 10. In a second position B, the valve 130 places the second side 110*g* of the hydraulic motor 110 in fluid communication with the pump 120 and the first side 110*f* of the motor 110 in fluid communication with the tank 20 such that the hydraulic motor is driven in a second rotational direction associated with reverse movement of the machine 10. In one configuration, forward or clockwise movement of the handles 86*b* and bar 86*a* moves the valve 130 towards the first position A for forward movement of the machine, while rearward or counterclockwise movement of the handles 86*b* and bar 86*a* moves the valve towards the second position B for reverse movement of the machine 10.

Figure 42:
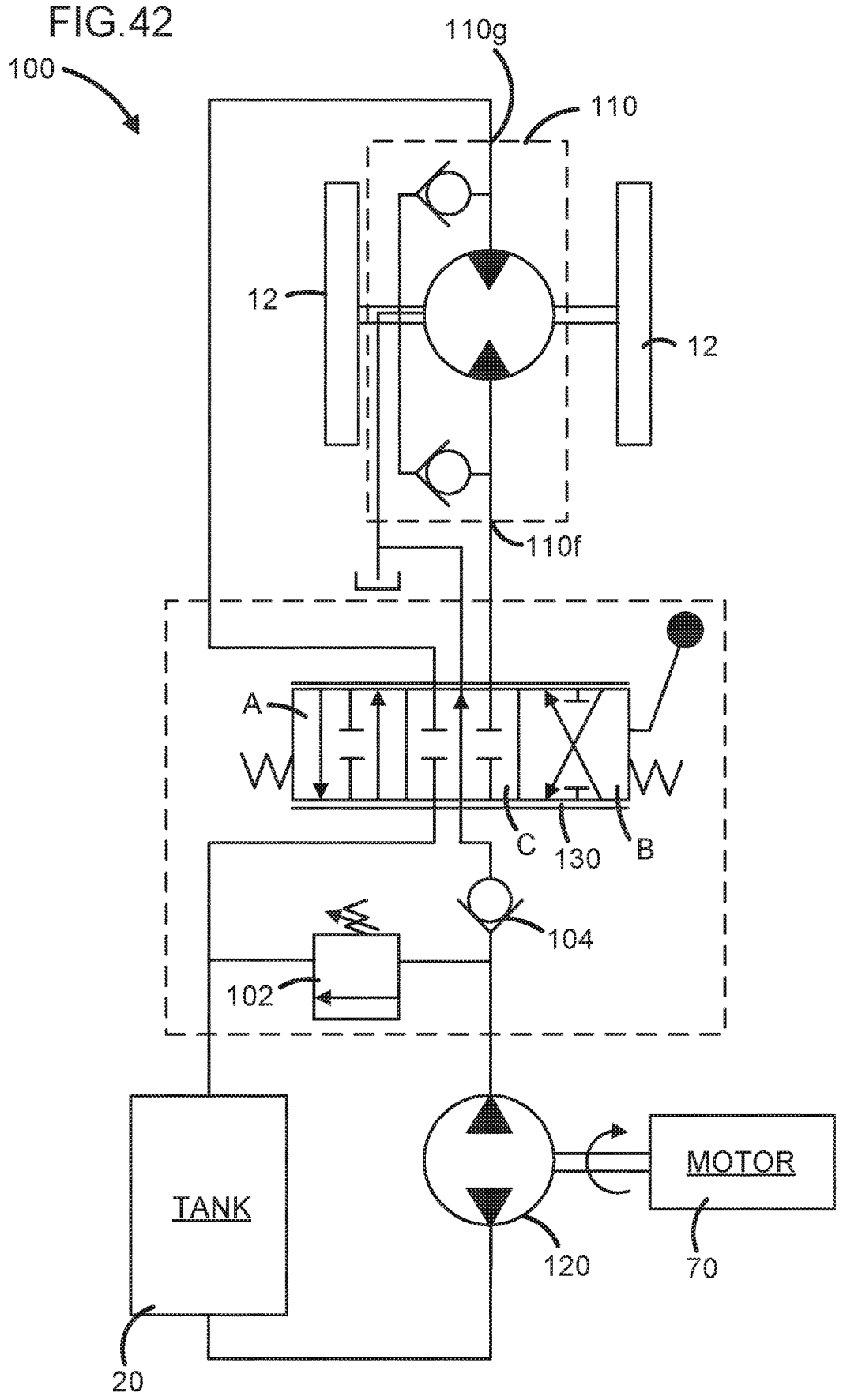
FIG. 42 is a hydraulic schematic of the hydraulic system of the walk-behind floor scraper machine shown in FIG. 1 utilizing a gear-type pump and hydraulic control valve.
Figure 43:
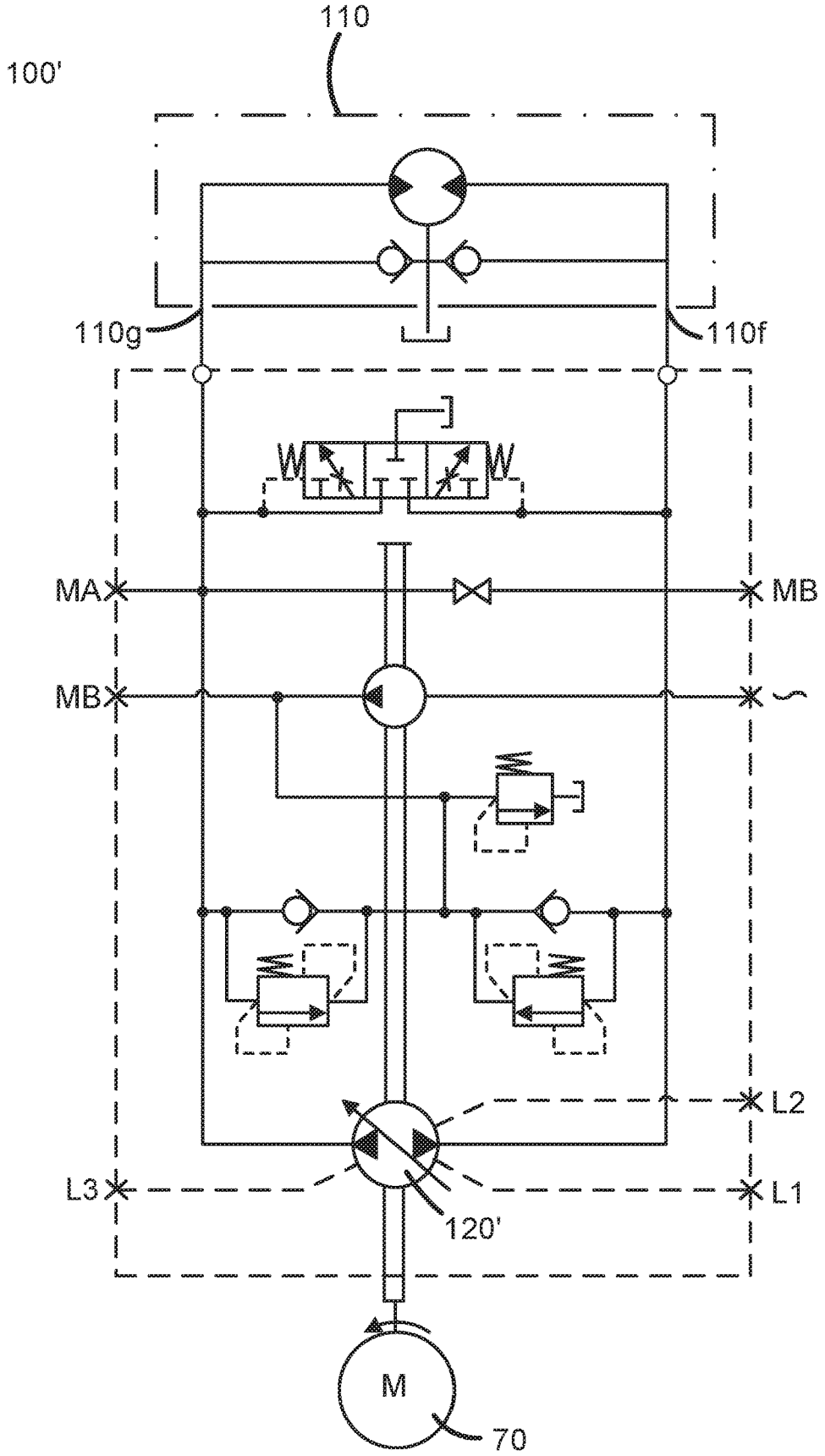
FIG. 43 is a hydraulic schematic of an alternative hydraulic system usable with the hydraulic system of the walk-behind floor scraper machine shown in FIG. 1 utilizing a hydrostatic-type pump.

Referring to FIG. 42, a different configuration of a hydraulic system 100 is shown in which the pump is instead shown as a hydrostatic type pump 120' with an adjustable swash plate 122'. As shown, the pump 120' is directly connected to the hydraulic motor 110. In such a configuration, the position of the swash plate 112' can be positioned to control the rotational direction and speed/torque output of the hydraulic motor 110, thus eliminating the need for control valve 130. In such an arrangement, linkages or cables extending from the handle bar 86*a* can be connected to the swash plate control 122'. Notably, the use of a hydrostatic pump reduces the total hydraulic fluid capacity required in the system over the type of system shown at FIG. 38. For example, a tank size of about a quart can be utilized in system 100' instead of a tank size of about 2 gallons in system 100.

From the forgoing detailed description, it will be evident that modifications and variations can be made in the aspects of the disclosure without departing from the spirit or scope of the aspects. While the best modes for carrying out the many aspects of the present teachings have been described in detail, those familiar with the art to which these teachings relate will recognize various alternative aspects for practicing the present teachings that are within the scope of the appended claims.

What is claimed is:

1. A subassembly for a walk-behind floor scraper machine for removing floor covering from a floor surface; the subassembly comprising:

a) a base frame defining an open channel with an end wall extending between a pair of sidewalls, the base frame extending between a first end and a second end, the end wall defining:
   i) a first opening and bolt pattern for accepting one of a plurality of different electric motor sizes;
   ii) a second opening and bolt pattern for accepting one of a plurality of different hydraulic pump sizes;
   iii) a third opening and bolt pattern for accepting one of a plurality of different scraper assemblies configured for orbital or reciprocating movement with respect to the base frame;

b) a tank-frame assembly including a mounting location for a hydraulic motor and defining an interior volume for storing hydraulic fluid of a hydraulic circuit, the tank-frame assembly being connected to the first end of the base frame;

c) a support arm structure for supporting a handle assembly, the support arm structure being connected to the tank-frame assembly;

d) a mounting bracket connected to the second end of the base frame, the mounting bracket including at least one through hole extending in a direction parallel to a length of the base frame and being configured to secure one of a plurality of differently weighted front weight assemblies; and e) a weighted shroud removably mounted to both the base frame and to the tank-frame assembly, the weighted shroud including at least one weight removably mounted to a shroud member defined by a top wall extending between a pair of sidewalls.

2. The subassembly for a walk-behind floor scraper machine of claim 1, wherein the support arm structure includes a pair of parallel support arms, each of which is connected to the tank-frame assembly.

3. The subassembly for a walk-behind floor scraper machine of claim 1, further including a front weight assembly mounted to the mounting bracket with a fastener extending through the at least one through hole.

4. The subassembly for a walk-behind floor scraper machine of claim 1, further including a handle assembly rotatably mounted to the support arm structure.

5. The subassembly for a walk-behind floor scraper machine of claim 1, wherein the mounting bracket includes a pair of slots that receive portions of the base frame end wall, and wherein the mounting bracket is connected to the base frame at least at the location where the pair of slots abut the end wall.

6. A subassembly for a walk-behind floor scraper machine for removing floor covering from a floor surface; the subassembly comprising:

a) a base frame defining an open channel with an end wall extending between a pair of sidewalls, the base frame extending between a first end and a second end, the end wall defining:

i) a first opening and bolt pattern for accepting one of a plurality of different electric motor sizes;

ii) a second opening and bolt pattern for accepting one of a plurality of different hydraulic pump sizes;

iii) a third opening and bolt pattern for accepting one of a plurality of different scraper assemblies configured for orbital or reciprocating movement with respect to the base frame;

b) a tank-frame assembly including a mounting location for a hydraulic motor and defining an interior volume for storing hydraulic fluid of a hydraulic circuit, the tank-frame assembly being connected to the first end of the base frame;

c) a support arm structure for supporting a handle assembly, the support arm structure being connected to the tank-frame assembly;

d) a mounting bracket connected to the second end of the base frame, the mounting bracket including at least one through hole extending in a direction parallel to a length of the base frame and being configured to secure one of a plurality of differently weighted front weight assemblies; and e) a front weight assembly mounted to the mounting bracket with a fastener extending through the at least one through hole.

7. The subassembly for a walk-behind floor scraper machine of claim 6, wherein the support arm structure includes a pair of parallel support arms, each of which is connected to the tank-frame assembly.

8. The subassembly for a walk-behind floor scraper machine of claim 6, further including a handle assembly rotatably mounted to the support arm structure.

9. The subassembly for a walk-behind floor scraper machine of claim 6, wherein the mounting bracket includes a pair of slots that receive portions of the base frame end wall, and wherein the mounting bracket is connected to the base frame at least at the location where the pair of slots abut the end wall.

10. A subassembly for a walk-behind floor scraper machine for removing floor covering from a floor surface; the subassembly comprising:

a) a base frame defining an open channel with an end wall extending between a pair of sidewalls, the base frame extending between a first end and a second end, the end wall defining:

i) a first opening and bolt pattern for accepting one of a plurality of different electric motor sizes;

ii) a second opening and bolt pattern for accepting one of a plurality of different hydraulic pump sizes;

iii) a third opening and bolt pattern for accepting one of a plurality of different scraper assemblies configured for orbital or reciprocating movement with respect to the base frame;

b) a tank-frame assembly including a mounting location for a hydraulic motor and defining an interior volume for storing hydraulic fluid of a hydraulic circuit, the tank-frame assembly being connected to the first end of the base frame;

c) a support arm structure for supporting a handle assembly, the support arm structure being connected to the tank-frame assembly;

d) a mounting bracket connected to the second end of the base frame, the mounting bracket including at least one through hole extending in a direction parallel to a length of the base frame and being configured to secure one of a plurality of differently weighted front weight assemblies; and e) a handle assembly rotatably mounted to the support arm structure.

11. The subassembly for a walk-behind floor scraper machine of claim 10, wherein the support arm structure includes a pair of parallel support arms, each of which is connected to the tank-frame assembly.

12. The subassembly for a walk-behind floor scraper machine of claim 10, wherein the mounting bracket includes a pair of slots that receive portions of the base frame end wall, and wherein the mounting bracket is connected to the base frame at least at the location where the pair of slots abut the end wall.

13. A subassembly for a walk-behind floor scraper machine for removing floor covering from a floor surface; the subassembly comprising:

a) a base frame defining an open channel with an end wall extending between a pair of sidewalls, the base frame extending between a first end and a second end, the end wall defining:

i) a first opening and bolt pattern for accepting one of a plurality of different electric motor sizes;

ii) a second opening and bolt pattern for accepting one of a plurality of different hydraulic pump sizes;

iii) a third opening and bolt pattern for accepting one of a plurality of different scraper assemblies configured for orbital or reciprocating movement with respect to the base frame;

b) a tank-frame assembly including a mounting location for a hydraulic motor and defining an interior volume for storing hydraulic fluid of a hydraulic circuit, the tank-frame assembly being connected to the first end of the base frame;

c) a support arm structure for supporting a handle assembly, the support arm structure being connected to the tank-frame assembly; and d) a mounting bracket connected to the second end of the base frame, the mounting bracket including at least one through hole extending in a direction parallel to a length of the base frame and being configured to secure one of a plurality of differently weighted front weight assemblies;

wherein the mounting bracket including a pair of slots that receive portions of the base frame end wall, and wherein the mounting bracket is connected to the base frame at least at the location where the pair of slots abut the end wall.

14. The subassembly for a walk-behind floor scraper machine of claim 13, wherein the support arm structure includes a pair of parallel support arms, each of which is connected to the tank-frame assembly.

* * * * *